US012760457B2

(12) United States Patent
Yamanashi et al.

(10) Patent No.: US 12,760,457 B2
(45) Date of Patent: Oct. 13, 2026

(54) SEWING MACHINE AND SEWING MACHINE CONTROL METHOD

(71) Applicant: BROTHER KOGYO KABUSHIKI KAISHA, Nagoya (JP)

(72) Inventors: Yoko Yamanashi, Konan (JP); Hidenori Oka, Tokai (JP); Hiroshi Kawasaki, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 165 days.

(21) Appl. No.: 18/616,272

(22) Filed: Mar. 26, 2024

(65) Prior Publication Data

US 2025/0277331 A1 Sep. 4, 2025

(30) Foreign Application Priority Data

Mar. 1, 2024 (JP) ..... 2024-031475

(51) Int. Cl.
*D05B 19/14* (2006.01)
*D05B 19/10* (2006.01)
*D05B 35/12* (2006.01)

(52) U.S. Cl.
CPC ..... *D05B 19/14* (2013.01); *D05B 19/10* (2013.01); *D05B 35/12* (2013.01)

(58) Field of Classification Search
CPC ..... D05B 19/141; D05B 19/00; D05B 19/16; D05B 55/12; D05B 3/06; D05B 3/08; D05B 3/10; D05B 3/00
See application file for complete search history.

(56) References Cited

U.S. PATENT DOCUMENTS 4,416,206 A * 11/1983 Matsumura ..... D05B 3/24 112/446
5,195,451 A * 3/1993 Nakashima ..... D05B 79/00 112/102.5
6,499,513 B1 * 12/2002 Couch ..... D05B 19/12 112/470.03
2009/0312861 A1 * 12/2009 Hirose ..... D05B 3/06 112/77
2013/0139739 A1 * 6/2013 Naka ..... D05B 19/105 112/470.05

(Continued)

FOREIGN PATENT DOCUMENTS

CN 216427768 U * 5/2022
JP 2009297190 A * 12/2009 ..... D05B 19/10

(Continued)

*Primary Examiner* — Clinton T Ostrup

(57) ABSTRACT

A sewing machine includes a pillar extending in an up-down direction, a bed extending from a lower end of the pillar in an extending direction orthogonal to the up-down direction, a needle bar, a presser bar, a projector configured to project a projection image onto a projection area on the bed, a feed dog provided on the bed and configured to move a workpiece on the bed; and a processor. The processor is configured to execute projecting a projection image onto the projection area, the projection image including a pattern image representing a buttonhole pattern, the buttonhole pattern being formed in a state in which a buttonhole presser is mounted to the presser bar, and sewing the buttonhole pattern on the workpiece by controlling the feed dog and the needle bar.

23 Claims, 12 Drawing Sheets

(56) References Cited

U.S. PATENT DOCUMENTS

| | | | | |
|---|---|---|---|---|
| 2020/0010991 | A1 | 1/2020 | Minematsu et al. | |
| 2022/0335856 | A1* | 10/2022 | Kvarnstrand | D05B 19/085 |
| 2023/0144574 | A1* | 5/2023 | Nilsson | D05B 19/12<br>112/470.01 |
| 2024/0392484 | A1* | 11/2024 | Imaizumi | D05C 5/02 |

FOREIGN PATENT DOCUMENTS

| | | | | |
|---|---|---|---|---|
| JP | 2020-005694 | A | 1/2020 | |
| WO | WO-2023153326 | A1 * | 8/2023 | D05B 81/00 |

* cited by examiner

SEWING MACHINE AND SEWING MACHINE CONTROL METHOD

REFERENCE TO RELATED APPLICATIONS

This application claims priority from Japanese Patent Application No. 2024-031475 filed on Mar. 1, 2024. The entire content of the priority application is incorporated herein by reference.

BACKGROUND ART

A known processor of a sewing machine including a projector selects one designated pattern from among a plurality of types of patterns, and generates a projection image that represents a sewing image of the designated pattern of the planned sewing size. The processor causes the projector to project the generated projection image at a position beyond a needle drop position toward an upstream side along a moving direction of a workpiece. The processor controls a moving portion and a sewing portion in accordance with pattern data to sew the designated pattern on a workpiece in the planned sewing size.

SUMMARY

The known sewing machine has nothing to project a buttonhole pattern which is a pattern of a hole into which a button is inserted and is formed when a buttonhole presser device is mounted.

Aspects of the disclosure provide a sewing machine and a sewing machine control method that improve user convenience when sewing a buttonhole pattern.

A sewing machine according to an aspect of the disclosure may include a pillar extending in an up-down direction; a bed extending from a lower end of the pillar in an extending direction orthogonal to the up-down direction; a needle bar; a presser bar; a projector configured to project a projection image onto a projection area on the bed; a feed dog provided on the bed and configured to move a workpiece on the bed; and a processor. The processor is configured to execute: projecting a projection image onto the projection area, the projection image including a pattern image representing a buttonhole pattern, the buttonhole pattern being formed in a state in which a buttonhole presser is mounted to the presser bar; and sewing the buttonhole pattern on the workpiece by controlling the feed dog and the needle bar. The processor of the sewing machine may help a user recognize the stitches of the buttonhole pattern by projecting the projection image onto the projection area before sewing the stitches of the buttonhole pattern. Thus, the sewing machine may improve the convenience of the user when sewing the buttonhole pattern, compared to the related art.

A sewing machine control method according to another aspect of the disclosure may include projecting a projection image onto a projection area of a sewing machine, the projection image including a pattern image representing a buttonhole pattern; and sewing the buttonhole pattern on a workpiece by controlling a feed dog of the sewing machine and a needle bar of the sewing machine.

DESCRIPTION

Figure 1:
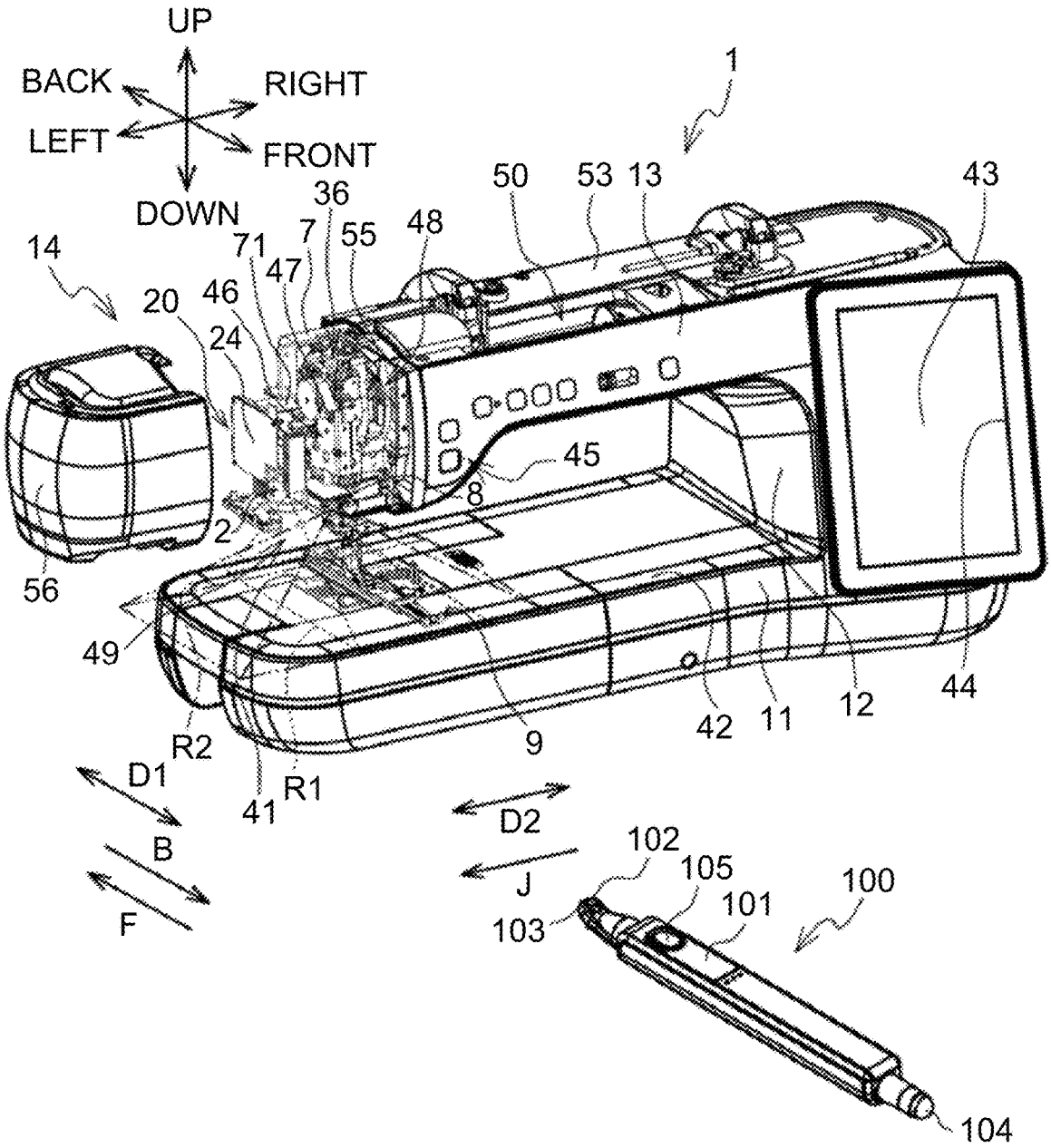
FIG. 1 is a perspective view of a sewing machine 1 in a state where a cover 56 is removed.

An embodiment of the present disclosure will be described with reference to the drawings. The up-down direction, the lower left direction, the upper right direction, the upper left direction, and the lower right direction in FIG. 1 are respectively the up-down direction, the left direction, the right direction, the rear direction, and the front direction of the sewing machine 1. A longitudinal direction D2 of the bed 11 and the arm 13 is the left-right direction of the sewing machine 1. A lateral direction D1 of the bed 11 and the arm 13 in a plane parallel to a horizontal direction is the front-rear direction of the sewing machine 1. In the sewing machine 1, the side on which the pillar 12 is disposed is the right side. The extension direction of the pillar 12 is the up-down direction of the sewing machine 1. The left side is defined as an extending direction J. A direction that is orthogonal to the extending direction J and the up-down direction and that extends from the needle bar 15 toward the presser bar 16 is rearward and is defined as a forward feed direction F. A direction opposite to the forward feed direction F is forward and is defined as a backward feed direction B. The forward feed direction F and the backward feed direction B are along the lateral direction D1. The extending direction J is along the longitudinal direction D2.

As shown in FIG. 1, a sewing machine 1 includes a bed 11, a pillar 12, and an arm 13. The pillar 12 extends in the up-down direction. The bed 11 extends from a lower end of the pillar 12 in an extending direction J orthogonal to the up-down direction. The arm 13 extends in the extending direction J in parallel with the bed 11 from an upper end of the pillar 12 above the bed 11. The arm 13 has a head 14 at its left end.

Figure 3A:
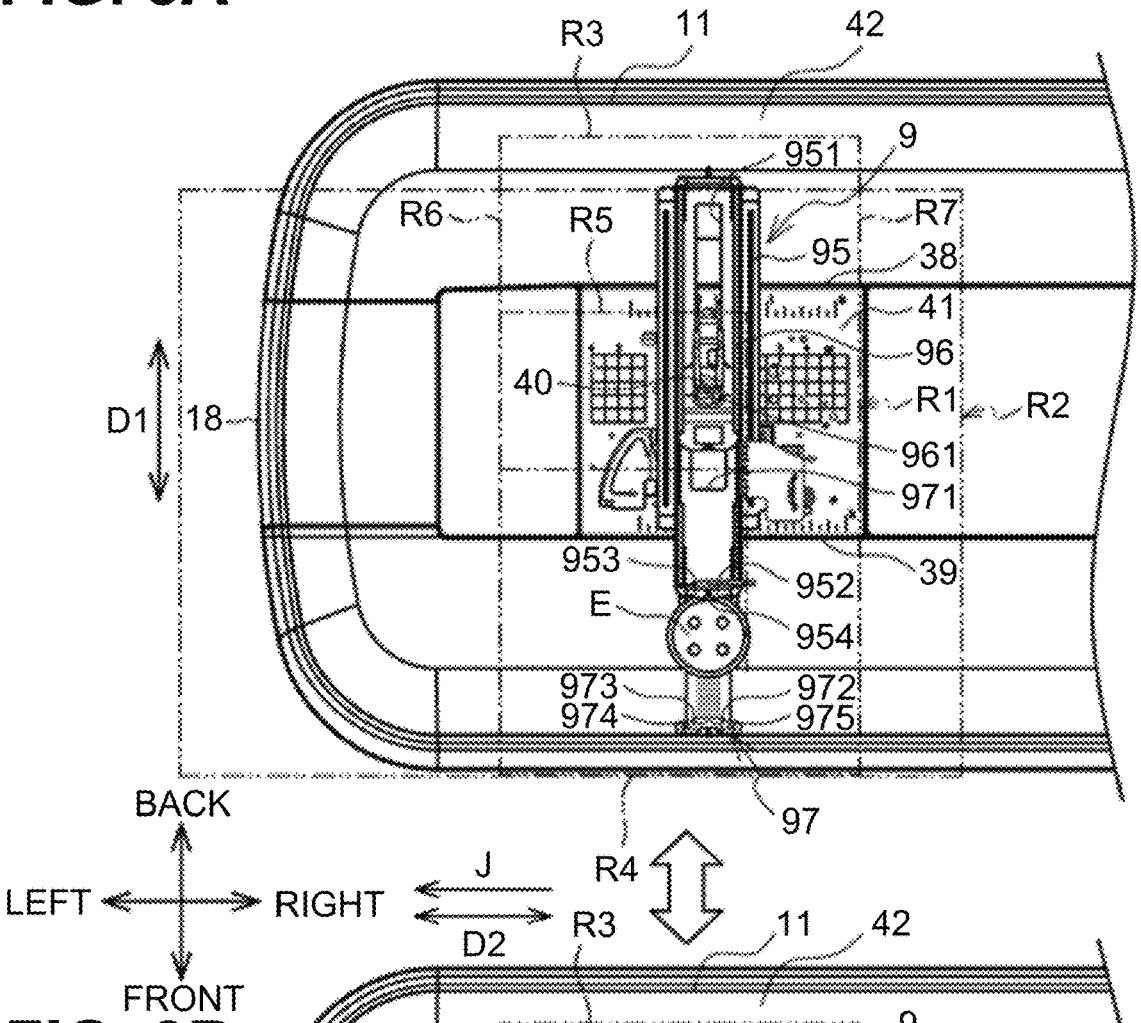
FIGS. 3A and 3B are plan views of a bed 11 in which a button E is arranged on a presser device 9 and the presser device 9.
Figure 11:
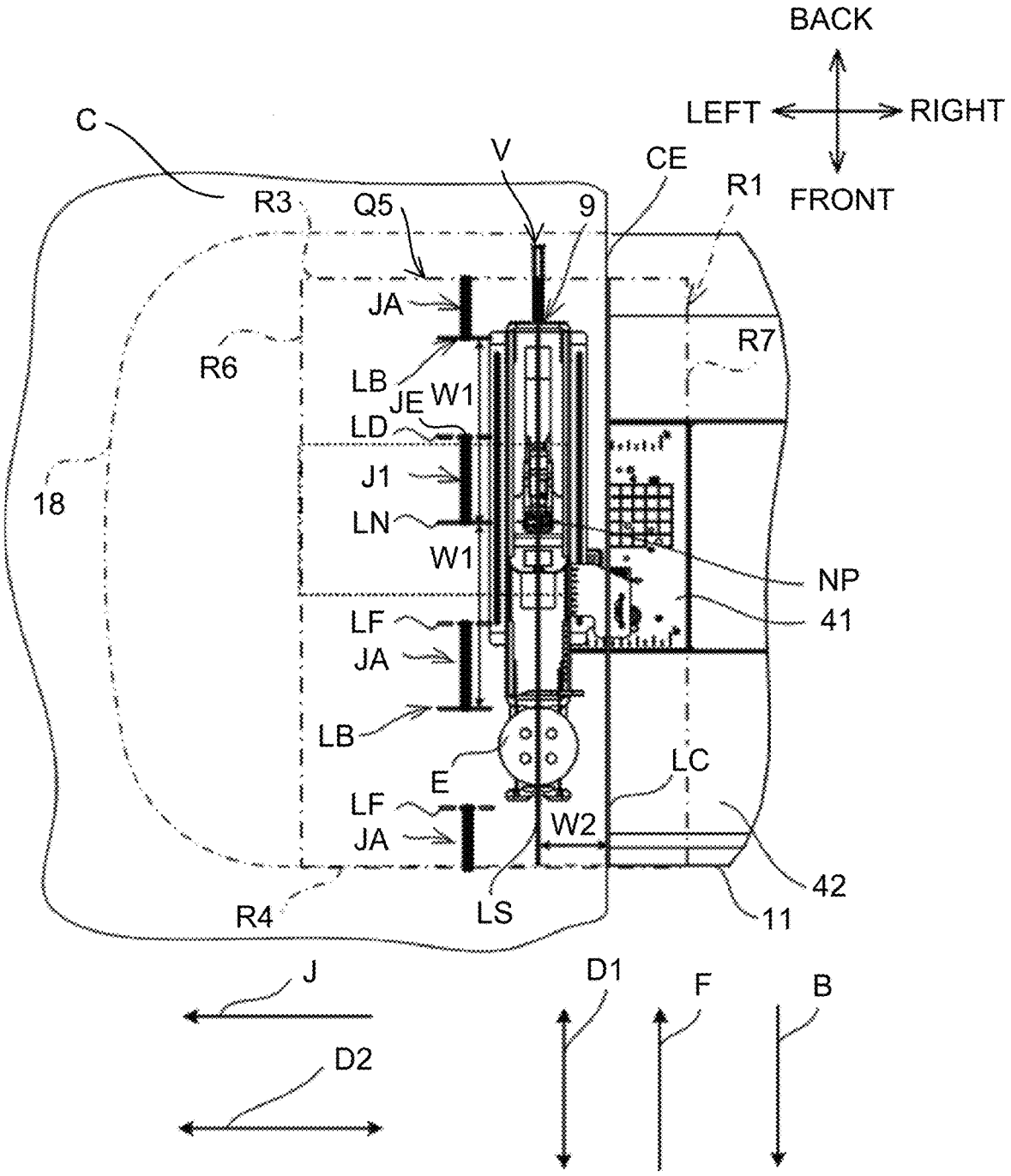
FIG. 11 is an explanatory view of a projection image projected on a projection area R1 when the first arrangement is selected.
Figure 12:
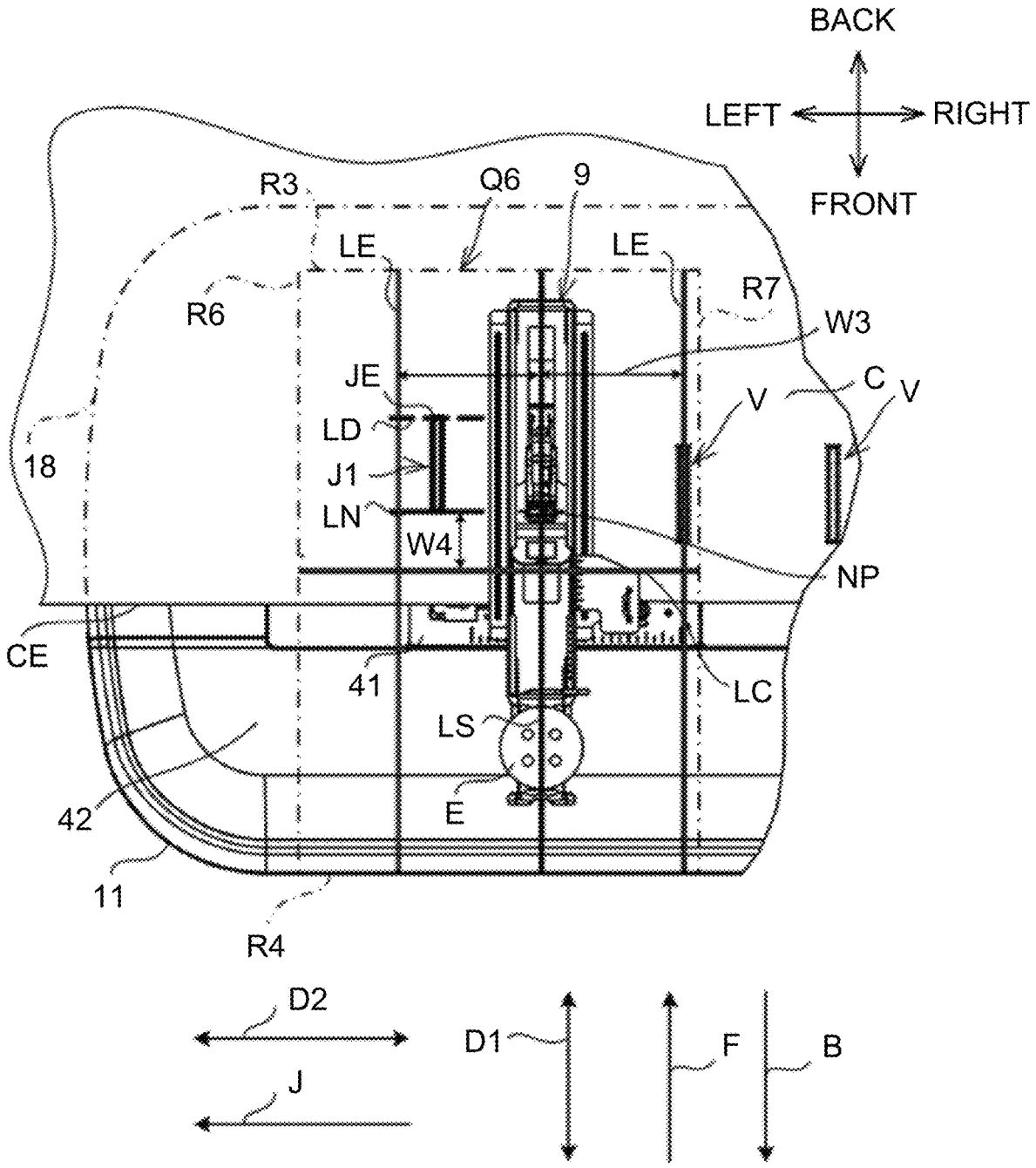
FIG. 12 is an explanatory view of a projection image projected on the projection area R1 when the second arrangement is selected.

An upper surface 42 of the bed 11 extends in the horizontal direction and includes a needle plate 41. As shown in FIG. 3A, a needle hole 40 through which a sewing needle 17 passes is formed in the needle plate 41. In the bed 11, a feed mechanism 31 shown in FIG. 4, a shuttle mechanism is provided below the needle plate 41. The feed mechanism 31 includes a feed dog 32. The feed mechanism 31 drives the feed dog 32 to move a workpiece C, which is shown in FIGS. 11 and 12, in the forward feed direction For the backward feed direction B by a predetermined movement amount. The forward feed direction F corresponds to a direction from the sewing machine 1 to the user. The shuttle mechanism includes a shuttle. The shuttle mechanism drives the shuttle to entangle an upper thread with a lower thread.

As shown in FIG. 1, a vertically elongated liquid crystal display (LCD) 43 and a touchscreen 44 are provided on the front side of the pillar 12. The LCD 43 indicates a message or the like necessary for the sewing operation. The touchscreen 44 is provided on the front surface of the LCD 43. When the user points an item displayed on the LCD 43 with a finger or a pointing device such as an end portion 104 of a dedicated pen 100, which will be described later, the touchscreen 44 detects the pointed position. The user may input various instructions to the sewing machine 1 via the touchscreen 44.

Figure 2:
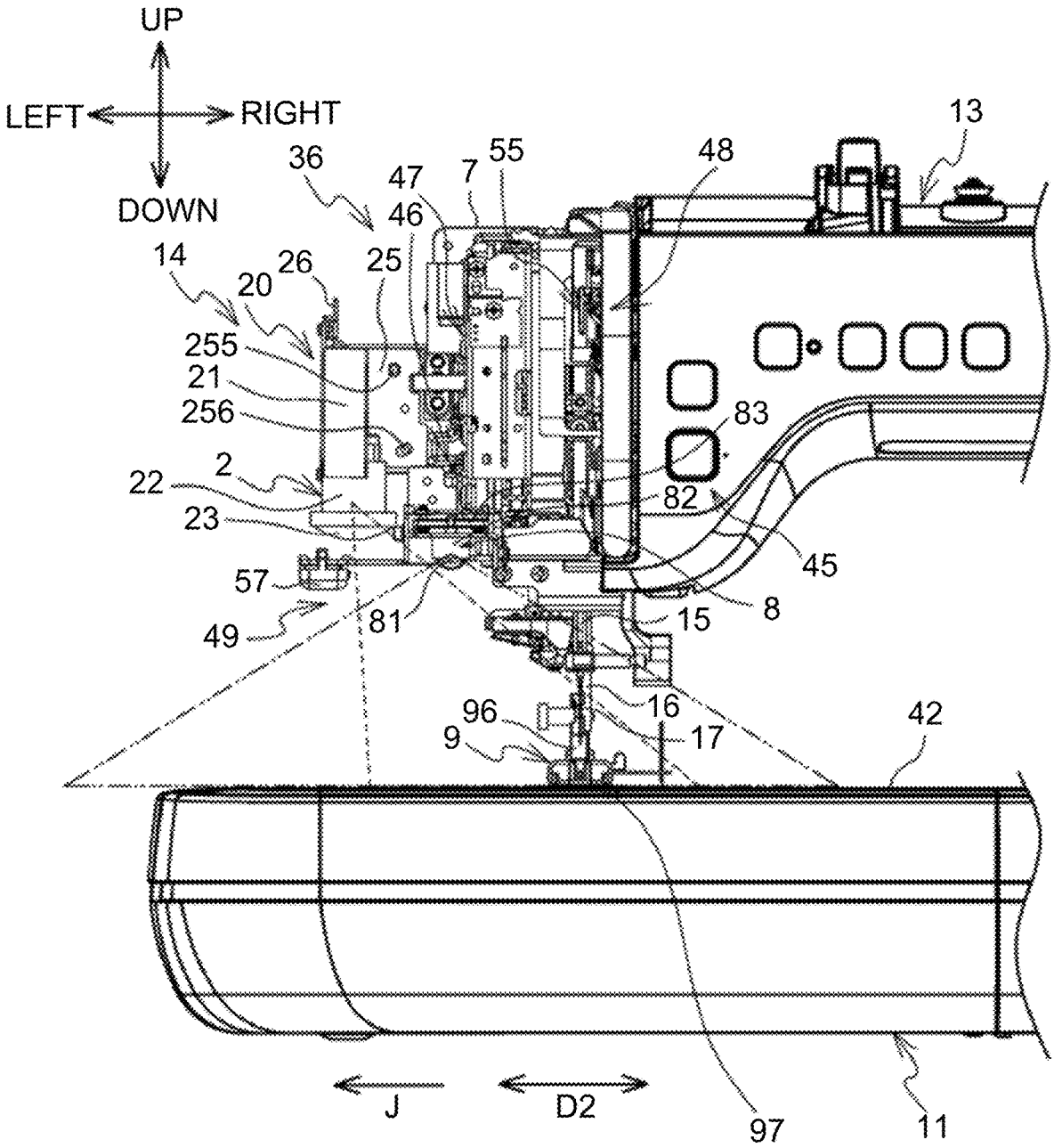
FIG. 2 is a front view of a head 14 of the sewing machine 1 in a state where the cover 56 is removed.

A plurality of switches including a start/stop switch 45 are provided on the front surface of the arm 13. The start/stop switch 45 is for instructing start or stop of a sewing motion. An openable and closable sewing machine cover is provided on an upper portion of the arm 13. In FIGS. 1 and 2, the sewing machine cover of the arm 13 is not illustrated. A thread storage 50 is provided on an upper surface 53 of the arm 13. The thread storage is accessible when the sewing machine cover is open. The thread storage 50 is recessed downward and may store a thread spool around which upper thread is wound. A thread spool pin extends leftward from a right inner surface of the thread storage 50. The thread spool is installed to the sewing machine 1 by having the thread spool pin inserted into a hole of the thread spool.

The arm 13 has an arm frame 7 extending from the upper end of the pillar 12 in the extending direction J. The arm frame 7 has a rectangular plate shape elongated in the left-right direction. The arm frame 7 is located closer to the forward feed direction F than the needle bar 15 and in the vicinity of a rear end of the arm 13. The arm frame 7 is made of a high thermal-conductive metal such as an aluminum alloy. The projector 2, which will be described later, is fixed to a front surface of an end portion 71 of the arm frame 7 in the extending direction J.

As shown in FIG. 2, the head 14 includes a needle bar mechanism 46, a swing mechanism 36, a presser foot mechanism 47, a thread take-up mechanism 48, a threading mechanism 49, an image sensor 8, and a projector module 20. As shown in FIG. 1, the head 14 further includes a cover 56 removable from the head 14. The needle bar mechanism 46, the presser foot mechanism 47, the thread take-up mechanism 48, the swing mechanism 36, the threading mechanism 49, the projector module 20, and the image sensor 8 are supported by a metal frame fixed to the front side of the arm frame 7, and are covered by the cover 56 while the cover 56 is attached to the head 14.

As shown in FIG. 2, the needle bar mechanism 46 has a needle bar 15 that extends in the up-down direction. The needle bar mechanism 46 is configured to reciprocate the needle bar 15 in the up-down direction. The needle bar 15 extends downward from a lower end of the head 14. The sewing needle 17 is detachably attached to a lower end of the needle bar 15. The sewing needle 17 reciprocates in the up-down direction as the needle bar 15 reciprocates. The upper thread through a hole of the sewing needle 17 is entangled with the lower thread by the shuttle to form a stitch on the workpiece C.

The swing mechanism 36 is configured to swing the needle bar 15 in the left-right direction with respect to the needle plate 41 by the swing motor 35. A center position in the left-right direction of the swing range of the needle bar 15 by the swing mechanism 36 is referred to as a center baseline position. A left end of the swing range of the needle bar 15 is referred to as a left baseline position. A right end of the swing range of the needle bar 15 is referred to as a right baseline position. A length of the swing range in the left-right direction may be appropriately set in accordance with the configuration of the swing mechanism 36. The length of the swing range may be 7 mm. Thus, a length between the left baseline position and the center baseline position in the left-right direction may be 3.5 mm. A length between the center baseline position and the right baseline position may also be 3.5 mm.

The presser foot mechanism 47 has a presser bar 16 extending in the up-down direction. The presser foot mechanism 47 is configured to reciprocate the presser bar 16 in the up-down direction. The presser bar 16 extends downward from the lower end of the head 14. A buttonhole presser device 9 is detachably mounted to a lower end of the presser bar 16. The buttonhole presser device 9 may be referred to as a presser device 9 hereinafter. The presser bar 16 is selectively positioned at a lowered position at which the workpiece C is pressed downward by the presser device 9 or a raised position, above the lowered position, at which the workpiece C can be placed on or removed from the needle plate 41 below the presser device 9. The presser device 9 is configured to move the workpiece C in the forward feed direction F or the backward feed direction B in cooperation with the feed dog 32 when the presser bar 16 is at the lowered position.

Figure 3B:
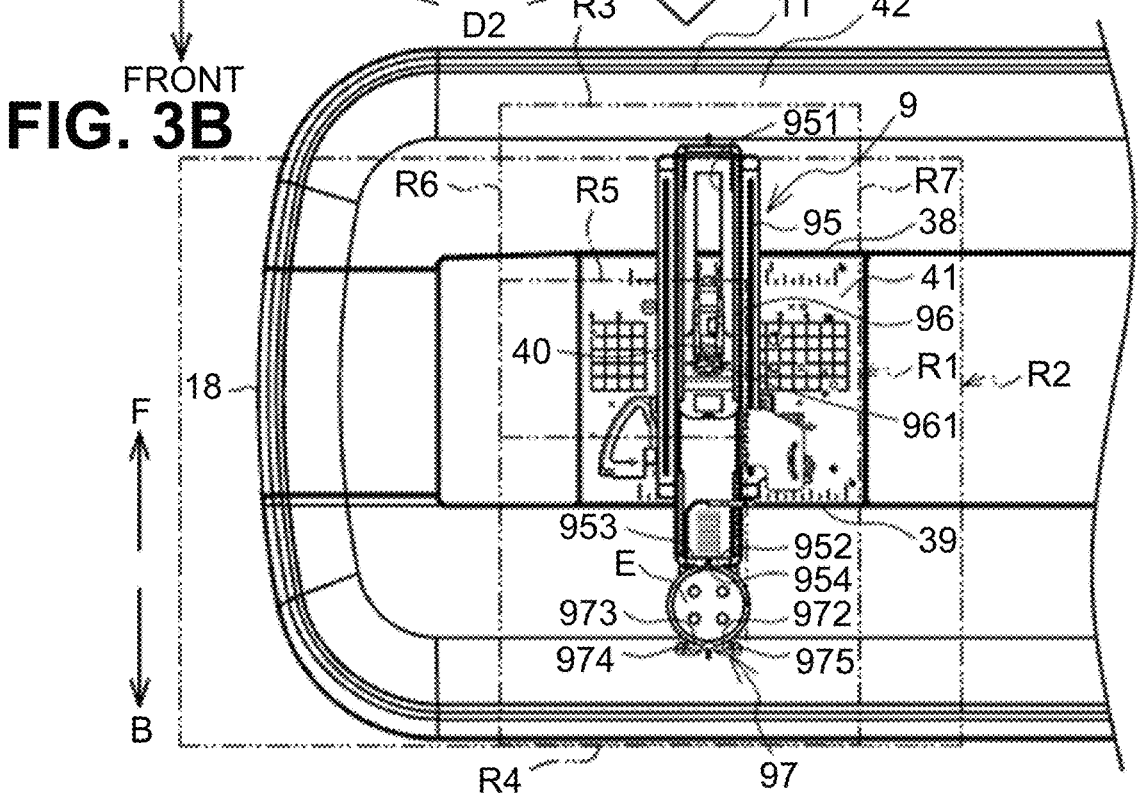

As shown in FIGS. 3A and 3B, the presser device 9 may be a presser foot used when sewing a buttonhole pattern, a darning stitch or a latch stitch. The presser device 9 includes a presser plate 95, a support base 96, and an adjustment plate 97. The presser plate 95 presses a periphery of the workpiece C where the stitches of the buttonhole pattern are formed. The presser plate 95 has a substantially rectangular shape elongated in the lateral direction D1 in a plan view. The presser plate 95 includes a through hole 951 extending through the presser plate 95 in the up-down direction. The adjustment plate 97 has a substantially rectangular shape elongated in the lateral direction D1 in a plan view. The adjustment plate 97 includes a through hole 971 extending through the adjustment plate 97 in the up-down direction. The adjustment plate 97 is supported by the presser plate 95 and the support base 96 so as to be slidable in the lateral direction D1 with respect to the presser plate 95 and the support base 96.

The support base 96 includes a needle drop hole 961 extending through the support base 96 in the up-down direction. The through hole 951 and the through hole 971 extends in the up-down direction such that the sewing needle 17 passes through the needle drop hole 961, the through hole 951, and the through hole 971 when sewing. When the presser device 9 is at the lowered position, the stitches are formed inside the through hole 951 and the through hole 971.

A front end portion 952 of the presser plate 95 has a shape such that the front end portion 952 protrudes upward first and is then bent forward. A marker 954 is arranged at a center of an upper surface 953 of the front end portion 952 in the left-right direction. The marker 954 of the present embodiment is a black circle printed on the upper surface 953. A front end portion 972 of the adjustment plate 97 has a shape such that the front end portion protrudes upward first and is then bent backward. The markers 974, 975 are arranged side by side in the left-right direction on an upper surface 973 of the front end portion 972 of the adjustment plate 97. Similarly to the marker 954, the markers 974, 975 of the present embodiment are black circles printed on the upper surface 973.

As shown in FIGS. 1 and 2, the thread take-up mechanism 48 has a thread take-up 55 having a hole through which the upper thread passes. The thread take-up 55 is in front of the needle bar 15. The thread take-up mechanism 48 is configured to reciprocate the thread take-up 55 in the up-down direction. As a result, the thread take-up 55 pulls up the upper thread and adjusts the position of the knot with the lower thread.

The threading mechanism 49 includes a knob 57. The knob 57 is supported so as to be movable in the up-down direction and rotatable around an axis extending in the up-down direction. As the knob 57 downwardly rotates, the threading mechanism 49 threads the upper thread through the hole of the sewing needle 17.

The image sensor 8 captures an image of an imaging area R2 on the bed 11. An example of an imaging target of the image sensor 8 is a projection image projected on the workpiece C. The image sensor 8 includes a second lens 81, a lens holder 82, and an imaging element 83. The reflected light reflected from the imaging target enters the second lens 81. The second lens 81 guides the reflected light to the imaging element 83. The second lens 81 is located further in the extending direction J than the needle bar 15, that is, on the left side in the longitudinal direction D2.

The lens holder 82 is above the second lens 81 and holds the second lens 81. The imaging element 83 is above the lens holder 82. The imaging element 83 may be a CMOS image sensor to detect the reflected light guided through the second lens 81 and output a signal corresponding to the detected reflected light. The imaging element 83 may alternatively be a CCD image sensor or other image sensor.

As shown in FIG. 3A, the imaging area R2 has a rectangular shape including at least a part of a projection area R1 of the projector 2. The short side of the imaging area R2 extends in the lateral direction D1 while the long side extends in the longitudinal direction D2. The end of the imaging area R2 in the extending direction J is located further in the extending direction J than the end of the bed 11 in the extending direction J. The end of the imaging area R2 in the forward feed direction F is closer to the backward feed direction B than the end of the bed 11 in the forward feed direction F. The imaging area R2 includes an entire area of the needle plate 41.

As shown in FIGS. 1 and 2, the projector module 20 is disposed so as to be spaced away from the needle bar 15 in the extending direction J. The projector module 20 includes a projector 2, a control circuit board 24, a heat radiation plate 25, and a fixing plate 26. The projector 2 is installed at a distal end of the arm 13 in the extending direction J, and is configured to project a projection image onto a projection area R1 on the bed 11. The projector 2 is fixed to the front surface of the end portion 71 of the arm frame 7. The projector 2 includes a generation unit 21, a light guide unit 22, and a first lens 23.

The generation unit 21 has a rectangular parallelepiped shape elongated in the front-rear direction. The generation unit 21 includes a reflective display device 213 illustrated in FIG. 4, a light source 212, a mirror and a prism. While the light source 212 is disposed either in the forward feed direction F or in the backward feed direction B with respect to the first lens 23, the light source 212 of the present embodiment is disposed in the forward feed direction F with respect to the first lens 23. The light source 212 may be an LED. The generation unit 21 projects light from the light source 212 onto an image displayed on the reflective display device 213, thereby generating image light that represents a projection image. Then, the generation unit 21 emits the generated image light toward the light guide unit 22. The generation unit 21 may alternatively emit the image light with a transmissive display device, a laser light source, or a self-emitting device.

The light guide unit 22 has a cylindrical shape extending in the up-down direction. The light guide unit 22 guides the image light generated by the generation unit 21 to the first lens 23. The image light guided by the light guide unit 22 is projected toward the bed 11 through the first lens 23.

The first lens 23 is at a lower end of the light guide unit 22. The first lens 23 is located further in the extending direction J than the second lens 81 of the image sensor 8. The first lens 23 is a decentered optical system projection lens. In the decentered optical system, lenses, mirrors, and other optical components are not aligned along a common central axis. The number, type, and arrangement of lenses and mirrors may be determined as appropriate.

As shown in FIG. 3A, the projection area R1 of the projector 2 has a rectangular shape. The long side of the projection area R1 is a side R6 and a side R7 each extending in the lateral direction D1. The short side of the projection area R1 is a side R3 and a side R4 each extending in the longitudinal direction D2. In the lateral direction D1, the first lens 23 is located further in the backward feed direction B than the needle bar 15. The projection area R1 includes a needle drop position NP that is positioned under the needle bar 15.

The side R3 that is the end of the projection area R1 in the forward feed direction F is located further in the forward feed direction F than an end 39 of the needle plate 41 in the forward feed direction F. The side R4 that is the end of the projection area R1 in the backward feed direction B is located further in the backward feed direction B than an end 38 of the needle plate 41 in the backward feed direction B. That is, in the lateral direction D1, the needle plate 41 is located between the side R3 and the side R4 of the projection area R1.

Since the projector 2 is disposed on the left front side with respect to the needle bar 15, when the projector 2 is driven, the shadow of the needle bar 15 is shown on the right rear side of the needle bar 15 by the image light projected from the projector 2. That is, the shadow of the needle bar 15 is not formed in the backward feed direction B with respect to the needle bar 15.

As shown in FIGS. 1 and 2, the control circuit board 24 is located further in the extending direction J than the generation unit 21 of the projector 2. The control circuit board 24 has a rectangular shape in a left side view. The longitudinal direction of the control circuit board 24 is parallel to the front-rear direction. A driver element, such as a driver IC, is mounted on the control circuit board 24. The driver element causes the generation unit 21 to generate the image light.

The heat radiation plate 25 is made of a thermally conductive material such as a metal. The heat radiation plate 25 has a bent plate shape and is fixed to the generation unit 21 and the end portion 71 of the arm frame 7. The heat radiation plate 25 is fixed to the front surface of the end portion 71 with screws 255, 256 between the generation unit 21 and the needle bar mechanism 46 in the longitudinal direction D2. The heat radiation plate 25 may conduct heat generated by the generation unit 21 to the arm frame 7. The fixing plate 26 has a bent plate shape. The fixing plate 26 connects the heat radiation plate 25 and the control circuit board 24.

The configuration of the pen 100 will be described with reference to the orientation in FIG. 1. The pen 100 includes a body 101, an end portion 102, a light emitter 103, an end portion 104, and a switch 105. The body 101 extends in a quadrangular prism shape. One end of the pen 100 in the longitudinal direction is the end portion 102. The other end of the pen 100 in the longitudinal direction is the end portion 104. The longitudinal direction of the pen 100 in FIG. 1 is the front-rear direction. The end portion 102 extends rearward from a rear end of the body 101 in an L shape. The light emitter 103 is at the end portion 102. The switch 105 is provided on the rear end side of the body 101. The light emitter 103 emits light while the switch 105 is pressed. The switch 105 may also be operated to input various instructions via the image sensor 8 based on an image projected by the projector 2. The end portion 104 is at a front end of the body 101. The end portion 104 is opposite to the end portion 102. The end portion 104 is used when various instructions are input via the touchscreen 44.

An operation of the sewing machine 1 having the above configuration will be briefly described. When the start/stop switch 45 is operated, the sewing machine 1 synchronously drives the shuttle mechanism, the feed mechanism 31, the needle bar mechanism 46, the presser foot mechanism 47, and the thread take-up mechanism 48. Thus, stitches are formed on the workpiece C placed on the upper surface 42 of the bed 11 by the sewing needle 17 attached to the needle bar 15.

A use case of the projector 2 and the image sensor 8 of the projector module 20 will be described. The projector 2 may be used when the user may need to, before sewing, check or recognize a location, an arrangement, or other characteristics of the stitches to be formed on the workpiece C. The projector 2 emits the image light representing the pattern selected by the user. The image light is projected onto the workpiece C placed on the bed 11.

In another case, the projector 2 may be used for calibrating the projector 2 before shipping the sewing machine 1. The projector 2 projects a predetermined calibration pattern in accordance with an instruction from an operator. The calibration pattern may be grid lines arranged in a lattice shape. The projected calibration pattern is captured by the image sensor 8. A processor unit 3 of the sewing machine 1, which will be described later with reference to FIG. 4, detects a distortion amount of the captured image, and stores the distortion amount in a storage device 64. When the processor unit 3 detects an instruction to project the image light representing the pattern after shipping the sewing machine 1, the processor unit 3 adjusts the image light emitted from the projector 2 such that the distortion is corrected based on the distortion amount stored in the storage device 64. As a result, the sewing machine 1 projects image light of an image onto the workpiece C without distortion.

Other use cases of the projector module 20 and the image sensor 8 may be available for various purposes.

An operation for detecting a size of a button E based on the captured image will be described with reference to FIGS. 3A and 3B. The user performs the following operation in a state where the presser bar 16 is at the lowered position to detect the size of the button E corresponding to the buttonhole pattern.

As shown in FIG. 3A, in a state where the front end portion 952 of the presser plate 95 and the front end portion 972 of the adjustment plate 97 are spaced from each other in the front-rear direction, the user places the button E for the buttonhole pattern between the front end portion 952 of the presser plate 95 and the front end portion 972 of the adjustment plate 97. As shown in FIG. 3B, the user moves the front end portion 972 of the adjustment plate 97 rearward until a rear surface of the front end portion 972 abuts against a front end of the button E. The user then inputs an image capture instruction to the sewing machine 1.

If detecting the image capture instruction, the sewing machine 1 performs image processing on the captured image that is output from the image sensor 8, detects the markers 974, 975, 954 in the captured image, and calculates a diameter of the button E as a size of the button E based on positional relationship between the detected markers 974, 975, 954.

Figure 4:
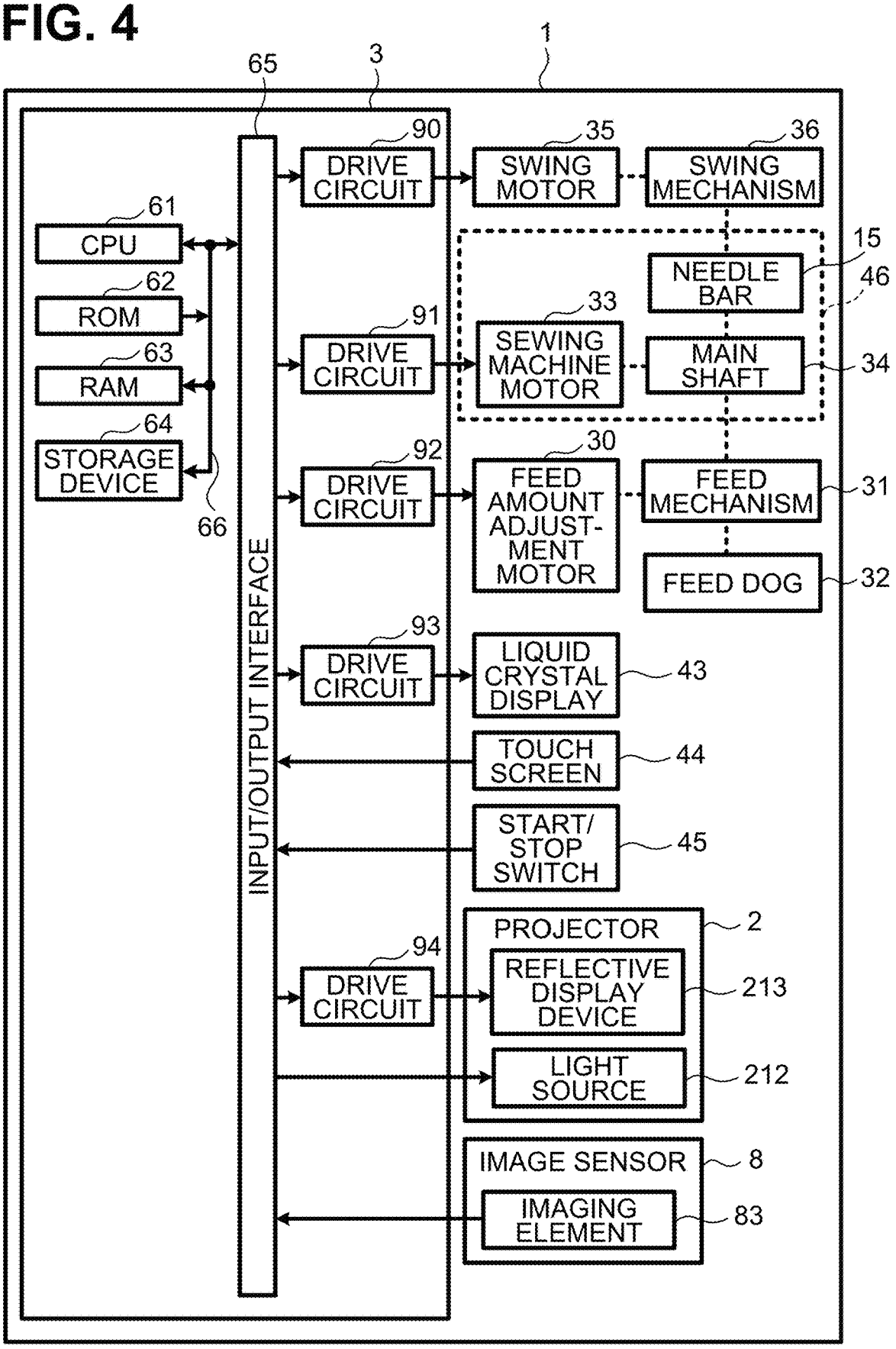
FIG. 4 is a block diagram showing an electrical configuration of the sewing machine 1.

An electric circuit configuration of the sewing machine 1 will be described with reference to FIG. 4. The processor unit 3 of the sewing machine 1 includes a CPU 61, a ROM 62, a RAM 63, a storage device 64, and an input/output interface 65. The CPU 61 is connected to the ROM 62, the RAM 63, the storage device 64, and the input/output interface 65 via a data bus 66.

The CPU 61 performs main control of the sewing machine 1, and performs various types of calculation and process in accordance with various programs stored in the ROM 62. The ROM 62 includes storage areas, such as a program storage area. Various programs for operating the sewing machine 1, including a program for executing main process that will be described later, are stored in the program storage area.

The RAM 63 includes a storage area for storing calculation results obtained by calculation process performed by the CPU 61.

The storage device 64 of the present disclosure may be a non-volatile memory or a volatile memory installed in the sewing machine 1. The storage device 64 may alternatively be a removable disk, such as a SD card, a microSD card or a similar removable device, installed in the sewing machine 1. Various parameters for the sewing machine 1 to execute various processes are stored in the storage device 64. The storage device 64 stores sewing data for sewing buttonhole patterns for the sewing machine 1 in association with pattern IDs for the buttonhole patterns.

The buttonhole pattern is formed on the workpiece C in the forward feed direction F from the needle drop position NP when the presser device 9 is mounted to the presser bar 16. The pattern ID is a numeric identifier for identifying a buttonhole pattern.

Figure 6:
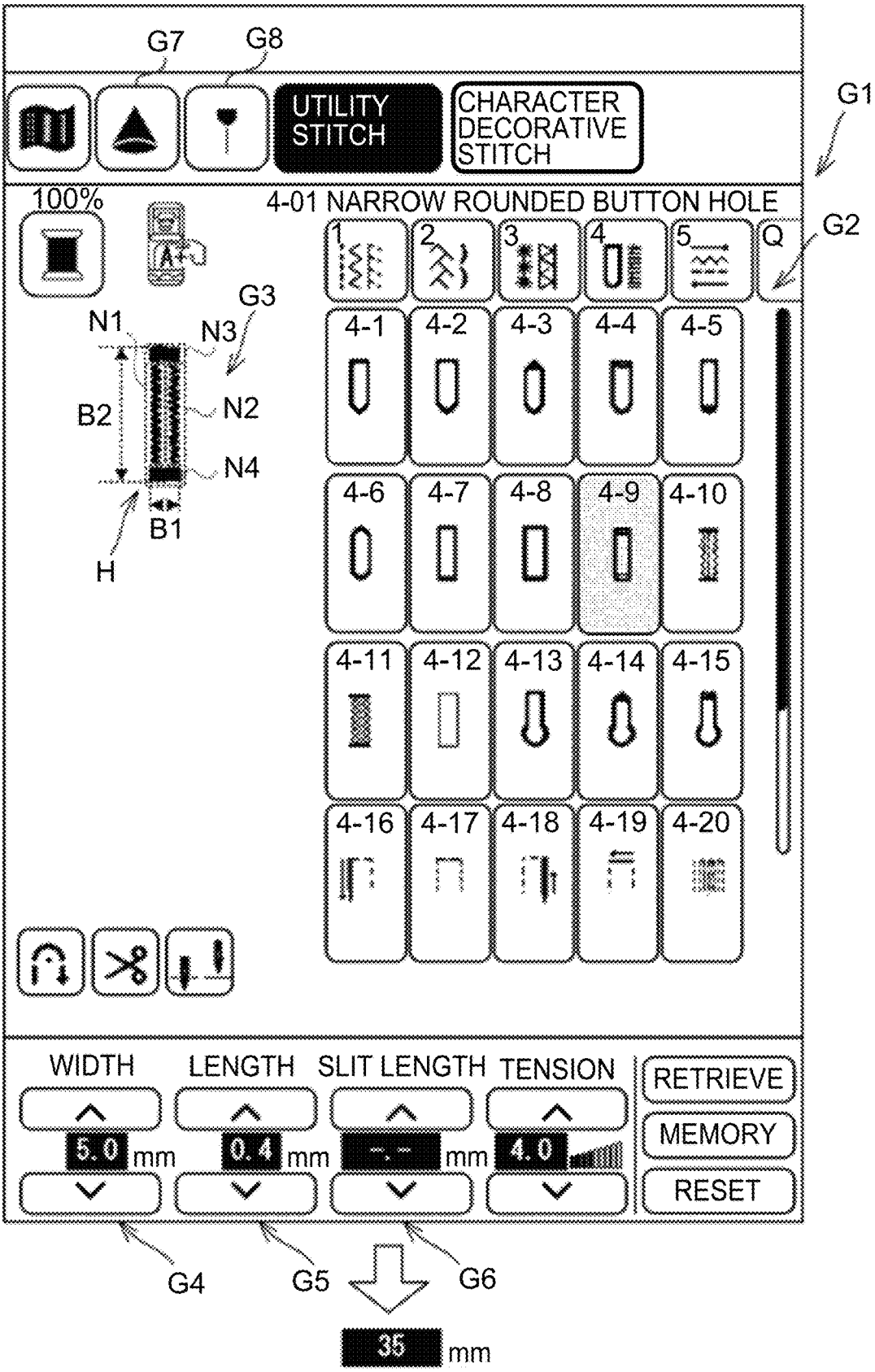
FIG. 6 is an explanatory diagram of a screen G1 displayed in the main process.

The buttonhole patterns may include a double-bar-tack buttonhole pattern, a blind buttonhole pattern, and an eyelet buttonhole pattern. The pattern image H shown in FIG. 6 represents stitches that are formed when the buttonhole pattern V shown in FIG. 12 is sewn. As illustrated in the pattern image H, each buttonhole pattern includes a first stitch stack N1, a second stitch stack N2, a third stitch stack N3 and a fourth stitch stack N4.

The first stitch stack N1 and the second stitch stack N2 each extend in the lateral direction D1 and face each other. The third stitch stack N3 and the fourth stitch stack N4 each extend in the longitudinal direction D2.

The first stitch stack N1 and the second stitch stack N2 are a pair of darning stitches extending in the longitudinal direction of the buttonhole pattern. The longitudinal direction of the buttonhole pattern is the lateral direction D1.

The third stitch stack N3 connects the first stitch stack N1 and the second stitch stack N2. The fourth stitch stack N4 is opposite to the third stitch stack N3 in the lateral direction D1 and connects the first stitch stack N1 and the second stitch stack N2.

In the present embodiment, the third stitch stack N3 connects an end of the first stitch stack N1 in the forward feed direction F and an end of the second stitch stack N2 in the forward feed direction F. The fourth stitch stack N4 connects the other end of the first stitch stack N1 in the backward feed direction B and the other end of the second stitch stack N2 in the backward feed direction B. Each of the third stitch stack N3 and the fourth stitch stack N4 may be a bar-tack stitch or a loop stitch.

The sewing machine 1 sews the buttonhole pattern while adjusting a feed amount of the workpiece C by the feed dog 32 and a swing width of the needle bar 15 in the left-right direction by the swing mechanism 36 in accordance with the sewing data for sewing the buttonhole pattern. The sewing machine 1 sets a length of the first stitch stack N1 and the second stitch stack N2 in the lateral direction D1 in accordance with the size of the button E, more specifically, a diameter of the button E. That is, a length B2 of the buttonhole pattern in the lateral direction D1 is determined in accordance with the length of the first stitch stack N1 and the second stitch stack N2 in the lateral direction D1.

The length of the first stitch stack N1 and the second stitch stack N2 in the lateral direction D1 may alternatively be set to a value obtained by adding a thickness of the button E to the diameter of the button E. In this case, the length B2 of the buttonhole pattern is set to a value obtained by adding the thickness of the button E and a length of the third stitch stack N3 and the fourth stitch stack N4 in the lateral direction D1 to the diameter of the button E. The thickness of the button E may be 2 mm. The length of the third stitch stack N3 and the fourth stitch stack N4 in the lateral direction D1 may be 1.5 mm. A length of the buttonhole pattern in the longitudinal direction D2 does not depend on the size of the button E and is a value unique to the buttonhole pattern.

The sewing data includes coordinate data. The coordinate data includes coordinate values of a plurality of needle drop points that form stitches that constitute the buttonhole pattern. Each coordinate value represents a relative position with respect to a reference position. The reference position may be a baseline position determined according to swing range of the needle bar 15 in the left-right direction by the swing mechanism 36. The baseline position may be any one of the center baseline position, the left baseline position, or the right baseline position. Since the relative positions of the center baseline position, the left baseline position, and the right baseline position are stored in the storage device 64 in advance, the processor unit 3 can identify the relative position with respect to the center baseline position even when any of the baseline positions is used as the reference position. The coordinate data of the present embodiment includes a data group representing coordinates of a plurality of relative positions with respect to the center baseline position for each needle drop point.

Alternatively, the reference position may be a position of the needle bar 15 in the left-right direction where the sewing needle 17 first pierces the workpiece C, that is, the position of the first stitch.

The storage device 64 of the present embodiment further stores a projection coordinate system of the projector 2, an image coordinate system that is a coordinate system of an image represented by image data captured by the image sensor 8, and a world coordinate system. Therefore, the sewing machine 1 can execute processing to identify the coordinates of the projection coordinate system based on the sewing data, and processing to identify the coordinates of the world coordinate system based on the image data. The projection image of the present embodiment is a color image in a plurality of colors, and the color of the projection image may be variable in accordance with the color, the pattern, and/or other characteristics of the workpiece C. Alternatively, the projection image may be a monochrome image.

The input/output interface 65 is connected to drive circuits 90, 91, 92, 93, 94 of the processor unit 3, the touch-screen 44, the start/stop switch 45, the light source 212, and the image sensor 8. The light source 212 is turned on in accordance with a control signal from the CPU 61, and emits light for projecting the projection image displayed on the reflective display device 213 onto the workpiece C placed on the bed 11.

A swing motor 35 is connected to the drive circuit 90. The drive circuit 90 drives the swing motor 35 in accordance with a control signal from the CPU 61. A sewing machine motor 33 is connected to the drive circuit 91. The drive circuit 91 drives the sewing machine motor 33 in accordance with a control signal from the CPU 61. As the sewing machine motor 33 is driven, the needle bar mechanism 46 is driven via a main shaft 34 of the sewing machine 1 so that the needle bar 15 moves up and down.

A feed amount adjustment motor 30 is connected to the drive circuit 92. The feed amount adjustment motor 30 adjusts a feed amount of the workpiece C in the front-rear direction by the feed mechanism 31 by rotating an output shaft. The drive circuit 93 displays an image on the LCD 43 by driving the LCD 43 in accordance with a control signal from the CPU 61. The drive circuit 94 drives the reflective display device 213 of the projector 2 in accordance with a control signal from the CPU 61, and causes the reflective display device 213 to display a projection image.

The main processing of the sewing machine 1 will be described with reference to FIGS. 5 to 12. In the main processing, a process for sewing a buttonhole pattern is executed in response to an instruction from the user. The main processing is started when the user inputs an instruction for displaying a screen G1 shown in FIG. 6. When detecting the instruction for displaying the screen G1, the processor unit 3 reads a program for executing the main processing stored in the program storage area of the ROM 62 and stores the read program to the RAM 63. The processor unit 3 executes the following steps in accordance with instructions in the program in the RAM 63. Various parameters for executing the main processing are stored in the storage device 64. Various kinds of data obtained in the course of the main processing are properly stored in RAM 63.

In the following description, various kinds of image data to be processed by the processor unit 3 are simply referred to as an image, a captured image, or a projection image. Step is abbreviated as S.

Figure 5:
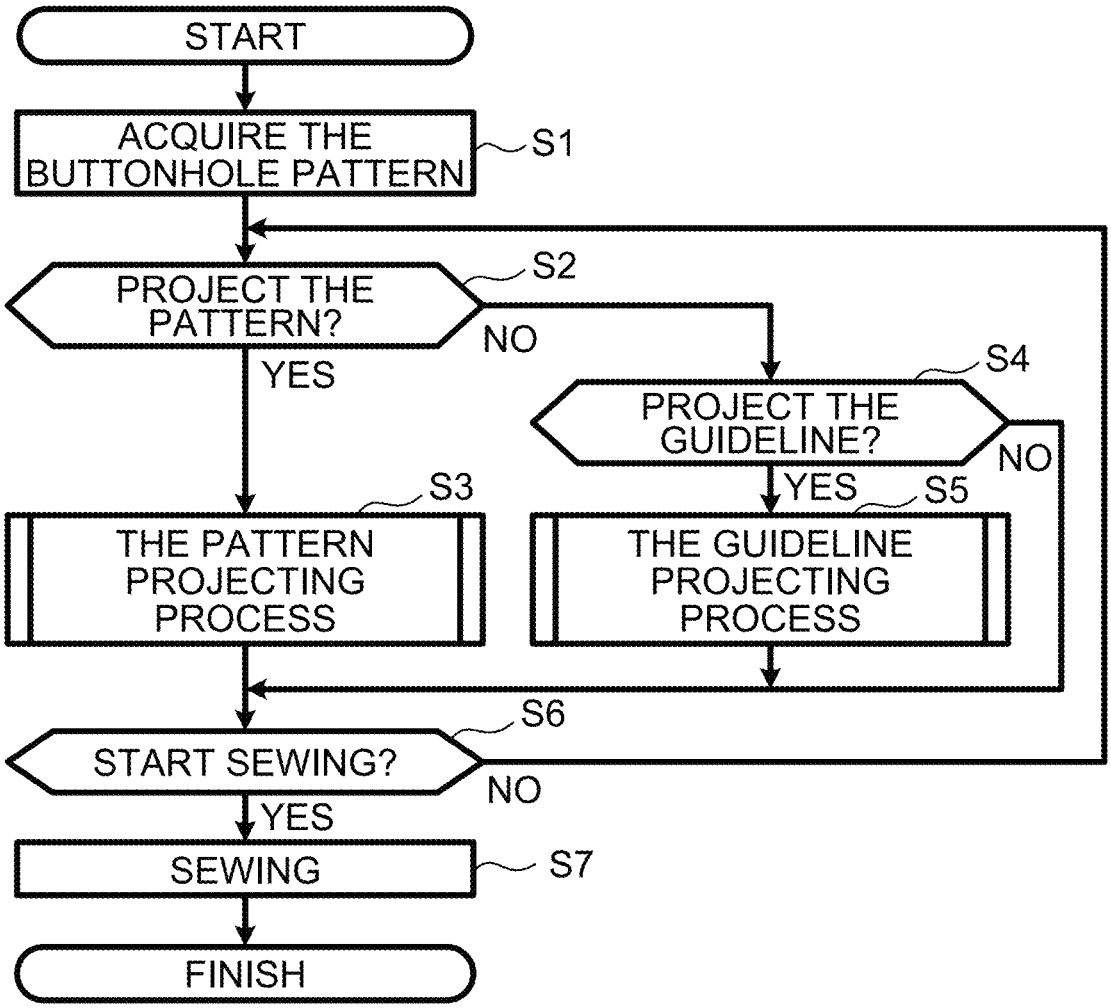
FIG. 5 is a flowchart of the main process.

As shown in FIG. 5, the processor unit 3 obtains a buttonhole pattern designated by the user from among a plurality of types of buttonhole patterns, stored in the storage device 64, displayed on the screen G1 of FIG. 6 (S1).

As shown in FIG. 6, the screen G1 includes fields G2, G3, G4, G5, G6, a key G7, and a key G8. In the field G2 are pattern IDs and pattern images for each of a plurality of types of buttonhole patterns that can be sewn by the sewing machine 1 in a state where the presser device 9 is mounted to the presser bar 16. The pattern image represents stitches that are formed when the buttonhole pattern is sewn. In the field G3 is a pattern image of a designated pattern of a buttonhole pattern designated by the user among the plurality of types of buttonhole patterns displayed in the field G2. The up-down direction and the left-right direction of the field G3 respectively correspond to the front-rear direction and the left-right direction of the sewing machine 1.

In the field G4 is a display field for displaying a length B1 of the designated pattern in the longitudinal direction D2, and a key for changing the length B1. In the field G5 is a display field for displaying a length of one-stitch-per-one-feed in the lateral direction D1 and a key for changing the length of the one-stitch-per-one-feed.

In the field G6 is a display field for displaying a length of the first stitch stack N1 and the second stitch stack N2 in the lateral direction D1, and a key for changing a length of a slit formation range. The slit formation range is an area surrounded by the stitch stacks N1, N2, N3 and N4. Normally, after the buttonhole pattern is sewn on the workpiece C, a user may form a slit for inserting a button E so as to extend in the lateral direction D1 within the slit formation range using a cutter such as scissors. An initial value of the display field of the field G6 is blank, and a numerical value is displayed when the size of the button E is detected or when a length of the slit formation range in the lateral direction D1 is set by the key of the field G6.

The key G7 is used to input a pattern-projection instruction for projecting a designated pattern. The key G8 is used to input a guideline-projection instruction for projecting guidelines. The processor unit 3 obtains the designated buttonhole pattern from among the plurality of types of buttonhole patterns displayed in the field G2, and displays in the field G3 a pattern image H of the designated pattern.

Figure 7:
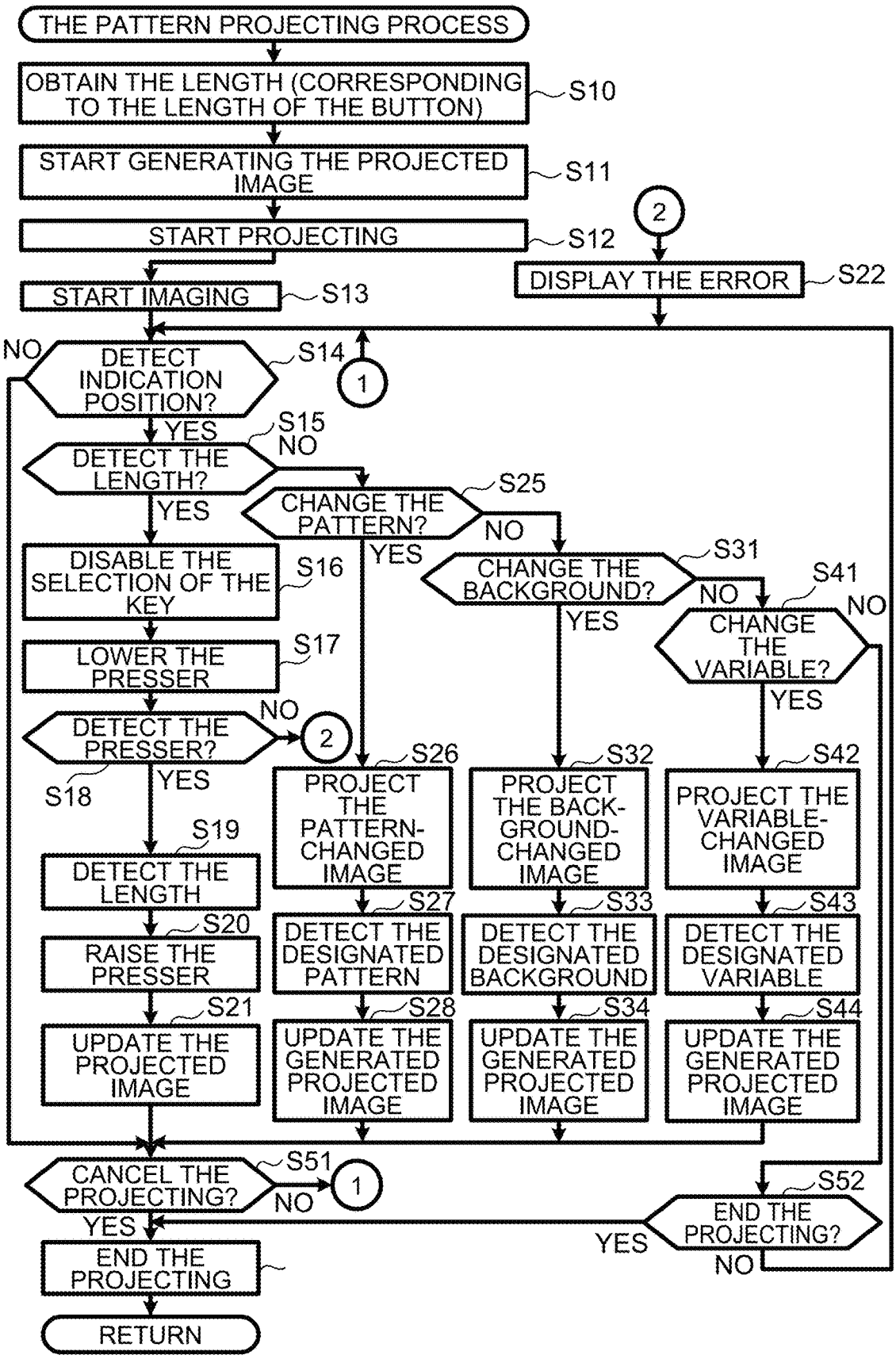
FIG. 7 is a flowchart of a pattern-projection process.

Based on whether the selection of the key G7 has been detected, the processor unit 3 determines whether a pattern-projection instruction for projecting the pattern image H of the designated pattern designated in S1 has been input (S2). When the pattern-projection instruction has been input (S2: YES), the processor unit 3 executes the pattern-projection process (S3). As shown in FIG. 7, in the pattern-projection process, first, the processor unit 3 executes a length-obtain process for obtaining a value related to the length of the button E in the lateral direction D1 (S10). The value related to the length of the button E may be an actual length of the button E in the lateral direction D1, or may be the length B2 of the buttonhole pattern in the lateral direction in the field G6.

The processor unit 3 generates a projection image (S11). The projection image generated in S11 includes a pattern image J1 that represents the stitches of the buttonhole pattern. The pattern image J1 represents a buttonhole pattern formed in a state where the presser device 9 is mounted to the presser bar 16. The processor unit 3 generates a projection image such that an end of the pattern image J1 is projected further in the forward feed direction F from the needle drop position NP. A position in the lateral direction D1 where the pattern image J1 is projected corresponds to a position in the lateral direction D1 where the stitches of the buttonhole pattern are formed. The processor unit 3 generates a projection image such that the pattern image J1 is projected between the end 18 of the bed 11 in the extending direction J and the needle drop position NP at a position where the pattern image J1 does not overlap the buttonhole presser device 9. The length of the first stitch stack N1 and the second stitch stack N2, included in the pattern image J1, in the lateral direction D1 are set based on a value related to the length of the button E in the lateral direction D1.

Figure 8A:
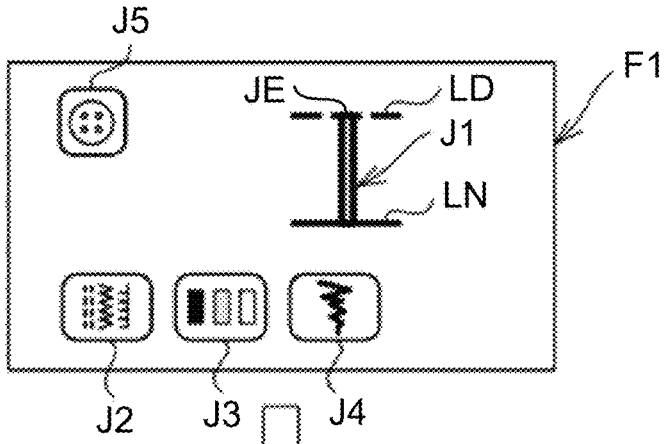
FIGS. 8A to 8D are explanatory views of transition of an image projected on an area R5 that is a part of a projection area R1.
Figure 8B:
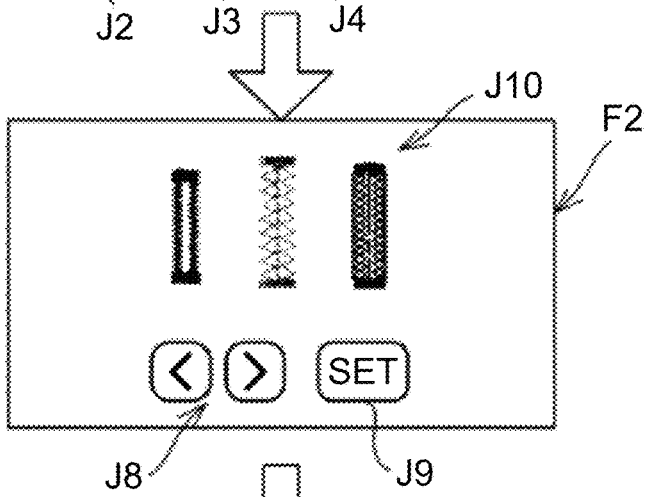
Figure 8C:
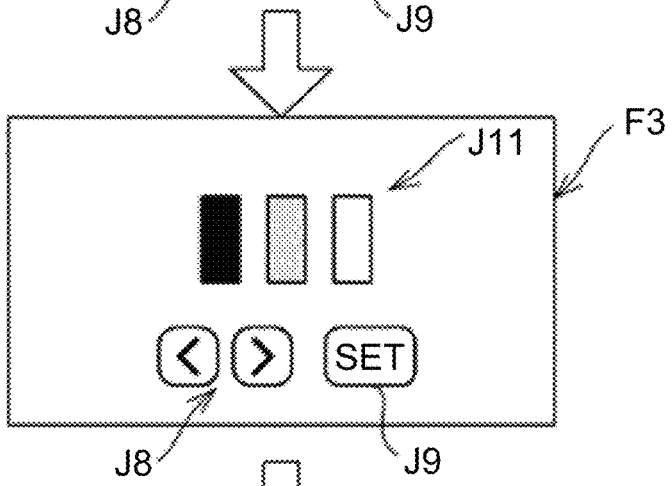
Figure 8D:
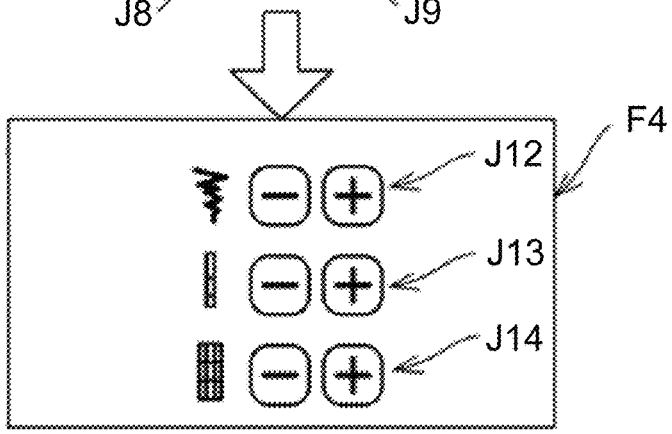

The processor unit 3 of the present embodiment generates in S11 a projection image including an image F1 shown in FIG. 8A. The image F1 is projected on an area R5 which is a part of the projection area R1. As shown in FIG. 3A, the area R5 has a rectangular shape included in the projected area R1. The long side of the area R5 extends from an end of the projected area R1 in the extending direction J to a right end of the presser device 9. The short side of the area 5 is located at the center of the projected area R1 in the lateral direction D1. The short side is shorter than the entire length of the projection area R1 in the lateral direction D1.

As shown in FIG. 8A, the image F1 includes a pattern image J1, a needle bar guideline LN, a size guideline LD, and keys J2, J3, J4, J5. The pattern image J1 represents the stitches of the buttonhole pattern designated in S1. The needle bar guideline LN is a line segment extending in the longitudinal direction D2. The needle drop position NP is located on the needle bar guideline LN or on an extension of the needle bar guideline LN. That is, a straight line passing through the needle drop position NP and extending in the longitudinal direction D2 overlaps with the needle bar guideline LN. A position of the needle bar guideline LN in the forward feed direction F is the same as the needle drop position NP in the forward feed direction F.

The size guideline LD is a line segment extending in the longitudinal direction D2. An end JE of the pattern image J1 in the forward feed direction F is located on the size guideline LD or on an extension of the size guideline LD. A position of the size guideline LD in the forward feed direction F is the same as a position of the end JE of the pattern image J1 in the forward feed direction F, that is, a position of the rear end of the pattern image J1. A length of the size guideline LD is identical to a length of the needle bar guideline LN. A position of the left end of the size guideline LD in the longitudinal direction D2 is the same as a position of the left end of the needle bar guideline LN in the longitudinal direction D2. In the present embodiment, the needle bar guideline LN may be a solid line, and the size guideline LD may be a line segment of a dotted line that is different from the solid line.

The key J2 is pointed for inputting a pattern change instruction for changing a buttonhole pattern. The key J3 is pointed for inputting a background change instruction for changing a background of the projection image. The key J4 is pointed for inputting a variable change instruction for changing a parameter of a buttonhole pattern. The start key J5 is a key to be selected when inputting a length detection instruction for detecting the diameter of the button E placed to the presser device 9. In the process of generating the projection image in S11, the projection image is generated and updated in accordance with the above instructions.

The processor unit 3 drives the projector 2 based on the projection image generated in S11, and causes the projector 2 to project the projection image generated in S11 onto the projection area R1 (S12). The processor unit 3 causes the image sensor 8 to capture an image (S13). The processor unit 3 executes an indication detection process for detecting an indication position that represents a position indicated by the pointing device on the bed 11 (S14). An example of the pointing device of the present embodiment is a pen 100. The processor unit 3 determines in S14 whether the indication position is detected when a light from the light emitter 103 of the pen 100 is detected in the captured image based on an image processing result of the captured image. When the indication position is not detected (S14: NO), the processor unit 3 executes a process of S51 described later. When the indication position is detected (S14: YES), the processor unit 3 determines a key that is one of the keys J2, J3, J4, J5 is indicated or pointed based on the position in the captured image where the light from the light emitter 103 of the pen 100 is detected (S15, S25, S31, S41).

For automatically detecting a diameter of a button, the user may point the start key J5 with the pen 100. When the start key J5 is projected at the indication position, the processor unit 3 executes a selection detection process of detecting that the start key J5 is pointed (S15). When it is detected that the start key J5 is pointed (S15: YES), the processor unit 3 disables detecting further keys (S16), and causes the presser bar 16 to move downward from the raised position to the lowered position (S17). After S17, the processor unit 3 performs image processing on the obtained captured image, and executes a determination process of determining whether the presser device 9 is mounted to the presser bar 16(S18). The processor unit 3 of the present embodiment determines that the presser device 9 has been mounted when a specific mark at a predetermined position of the presser device 9 is detected based on the captured image. If it is not detected that the presser device 9 is mounted to the presser bar (S18: NO), the processor unit 3 causes the presser bar 16 to move upward from the lowered position to the raised position, displays an error message in the LCD 43 (S22), and returns the process to S14. The error message may be "Please mount the buttonhole pattern presser device to the presser bar."

If it is detected that the presser device 9 is mounted to the presser bar 16 (S18: YES), the processor unit 3 executes a size detection process of detecting a size of a button placed to the presser device 9 based on the captured image (S19). The processor unit 3 detects the size, that is, the diameter of the button E based on locations of the markers 954, 974, 975 on upper surface 953 and the upper surface 973 of the presser device 9 in the captured image. Then, the processor unit 3 causes the presser bar 16 to move upward from the lowered position to the raised position (S20). Based on the size of the button E detected in S19, the processor unit 3 generates a projection image including the pattern image J1 in which the length of the first stitch stack N1 and the second stitch stack N2 in the lateral direction D1 are set, and updates the projection image (S21).

Based on whether the key G7 is pointed during the pattern-projection process, the processor unit 3 determines whether an abort instruction to abort the projecting is input (S51). If the abort instruction is not input (S51: NO), the processor unit 3 returns the process to S14. When the abort instruction is input (S51: YES), the processor unit 3 ends projecting the projection image (S53).

When the key J2 is pointed (S14: YES, S15: NO, S25: YES), the processor unit 3 generates a pattern-changed image and projects the generated pattern-changed image in the area R5 (S26). The pattern-changed image includes the image F2 shown in FIG. 8B. The image F2 includes keys J8, J9 and a field J10. The key J8 is pointed for inputting an instruction to change the selected buttonhole pattern. The key J9 is pointed for setting the selected buttonhole pattern. In the field J10, some of the buttonhole patterns are displayed. In the field J10 of the present embodiment, the currently designated pattern is positioned at the center. The designated patterns having IDs before and after the currently designated pattern are positioned on the left and right, respectively. In response to pointing the key J8, the patterns included in the field J10 is replaced. When the key J9 is pointed, the processor unit 3 determines the buttonhole pattern at the center in the field J10 as the designated pattern (S27), and generates a projection image similar to the image F1 for the determined designated pattern. The processor unit 3 causes the projector 2 to project the generated projection image (S28).

When the key J3 is pointed (S14: YES, S15: NO, S25: NO, S31: YES), the processor unit 3 generates a background-changed image and projects the generated background-changed image in the area R5 (S32). The background-changed image includes the image F3 shown in FIG. 8C. The image F3 includes keys J8, J9, and a field J11. In the field J11, options for the background color of the projection image are displayed. In the field J11 of the present embodiment, three options for the background color are displayed and arranged in the left-right direction. In response to pointing the key J8, options of the background color displayed in field J11 is replaced. When the key J9 is pointed, the processor unit 3 determines the background color at the center in the field J11 as the background color of the projection image (S33), and generates a projection image similar to the image F1 having the determined background color. The processor unit 3 causes the projector 2 to project the generated projection image (S34).

When key J4 is pointed (S14: YES, S15: NO, S25: NO, S31: NO, S41: YES), the processor unit 3 generates a variable change image including an operation key for designating a parameter of a buttonhole pattern, and projects the generated variable change image in the area R5 (S42). The variable change image includes the image F4 shown in FIG. 8D. The image F4 includes fields J12, J13, J14. In the field J12 are displayed operation keys for setting a length of the designated pattern in the longitudinal direction D2. In the field J13 is displayed an operation key for setting a stitch pitch in the lateral direction D1. In the field J14 are displayed operation keys for setting the baseline position to one of the left baseline position, the middle baseline position or and the right baseline position. The processor unit 3 executes an indication detection process for detecting an indication position that represents a position indicated by the pointing device. When any of the operation keys displayed in the fields J12, J13, J14 is pointed, parameter detection process for setting a parameter corresponding to the designated operation key is executed (S43). The operation data is related to an operation for changing a parameter with the operation keys, and may include status of an operation key, the number of times an operation key is pointed, and the time period an operation key is pointed.

The processor unit 3 sets the length of the designated pattern when the operation key of the field J12 is at the indication position. When the operation key of the field J13 is at the indication position, the processor unit 3 sets the stitch pitch in the lateral direction D1. When the operation key of the field J14 is at the indication position, the processor unit 3 sets the baseline position to one of the left baseline position, the middle baseline position, or the right baseline position. The processor unit 3 generates a projection image with the image F1 updated based on the updated parameter. The processor unit 3 causes the projector 2 to project the generated projection image (S44). The projection image projected in S44 includes the pattern image J1 updated on the basis of the parameter determined in S43.

The processor unit 3 performs the process of S51 after any one of S28, S34, and S44. If any key is not pointed (S41: NO), the processor unit 3 determines whether an end instruction to terminate the projecting is input (S52). When the end instruction is not input (S52: NO), the processor unit 3 returns the process to S14. When the end instruction is input (S52: YES), the processor unit 3 terminates projecting by the projector 2, and terminates the pattern-projection process.

When the pattern-projection instruction has not been input (S2: NO), the processor unit 3 determines whether a guideline-projection instruction for projecting guidelines of the designated pattern designated in S1 has been input, based on whether the key G8 has been pointed (S4). When the guideline-projection instruction has been input (S4: YES), the processor unit 3 executes the guideline-projection process (S5).

Figure 9:
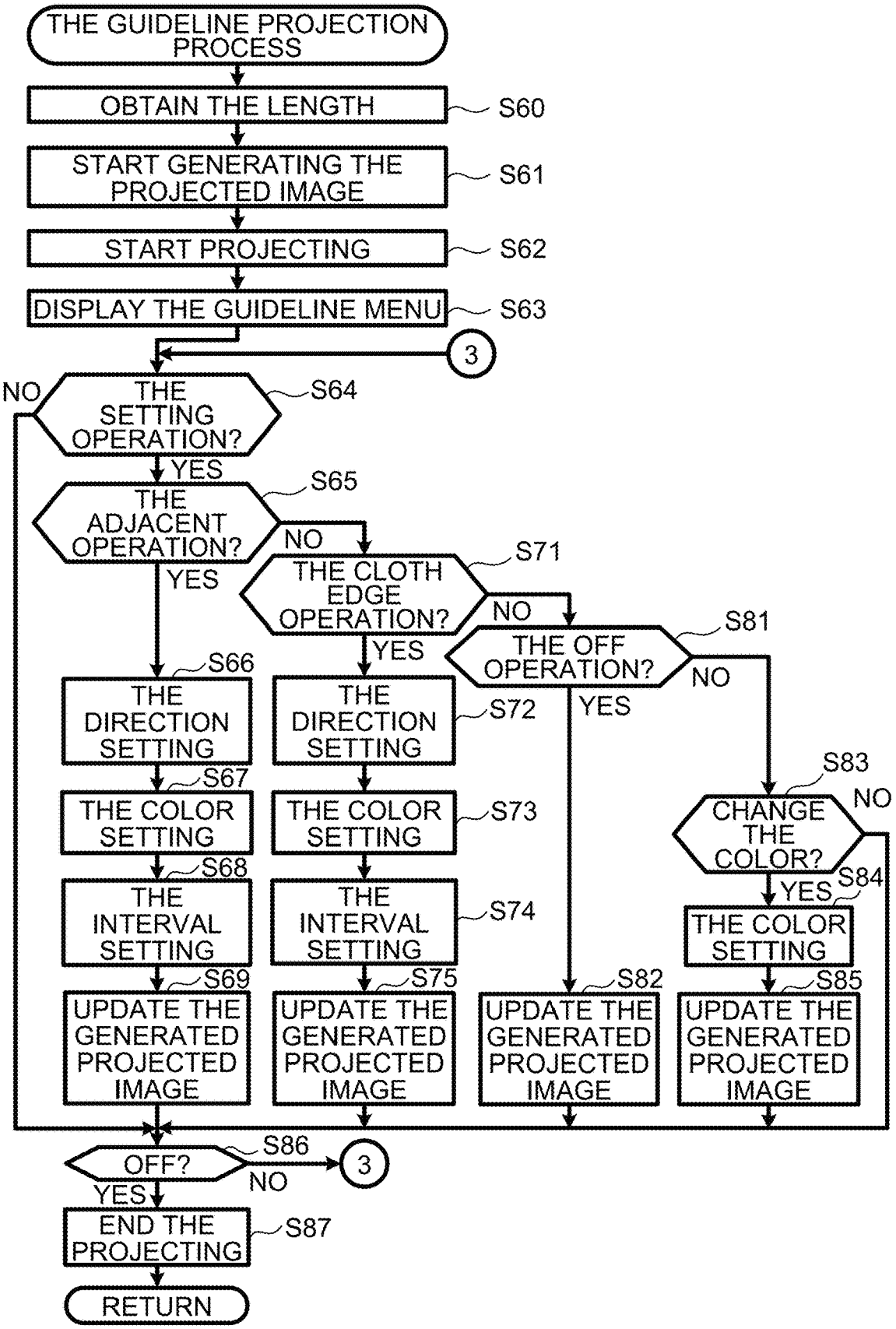
FIG. 9 is a flowchart of a guideline projection process.

As shown in FIG. 9, similarly to S10, the processor unit 3 executes a length-obtain process for obtaining a value related to the length of the button E in the lateral direction D1 (S60). The processor unit 3 generates a projection image (S61). The projection image generated in S61 includes a pattern image J1 that represents a buttonhole pattern to be formed in a state where the presser device 9 is mounted to the presser bar 16. The processor unit 3 generates a projection image such that an end JE of the pattern image J1 is projected further in the forward feed direction F than the needle drop position NP. The processor unit 3 of the present embodiment generates a projection image with the currently set guideline, in addition to the pattern image J1.

In the sewing machine 1 of the present embodiment, as shown in FIGS. 11 and 12, various projection conditions can be set for each of the four guidelines, namely, the needle bar guideline LN, the size guideline LD, the sewing guideline LS, and the workpiece guideline LC. In the sewing machine 1, the various projection conditions can further be set for button guidelines, such as a first button guideline LB, a second button guideline LF and a button guideline LE. The projection conditions of the present embodiment may include projecting or not projecting those guidelines. The projection conditions may also include color of those guidelines and a distance between the needle drop position NP and each guideline.

The sewing guideline LS is a line segment extending in the forward feed direction F. The pattern image J1 is projected parallel to the sewing guideline LS along the longitudinal direction D2. The needle drop position NP is located on the sewing guideline LS or on an extension of the sewing guideline LS. The position of the sewing guideline LS in the longitudinal direction D2 is the same as the needle drop position NP.

The size guideline LD extends in the longitudinal direction D2. An end JE of the pattern image J1 in the forward feed direction F is located on the size guideline LD or on an extension of the size guideline LD. The size guideline LD is distant from the needle bar guideline LN in the forward feed direction F. The distance between the size guideline LD and the needle bar guideline LN in the forward feed direction F is equal to or greater than the diameter of the button E placed to the presser device 9. The workpiece guideline LC represents a reference position of an end CE of the workpiece C.

In a case where a plurality of buttonhole patterns are formed side by side in a particular direction, the button guideline is projected at a position that is distant by a particular distance from the needle drop position NP in the particular direction. The button guideline may be a first button guideline LB and a second button guideline LF shown in FIG. 11 in a case where the plurality of buttonhole patterns are formed side by side in the lateral direction D1. The button guideline may be a button guideline LE shown in FIG. 12 in a case where the plurality of buttonhole patterns are formed side by side in the longitudinal direction D2.

As shown in FIG. 11, the first button guideline LB extends in the longitudinal direction D2. The first button guideline LB is projected so as to be distant from the needle bar guideline LN in the lateral direction D1. The second button guideline LF is projected together with the first button guideline LB when the size guideline LD is projected. The second button guideline LF is spaced apart from the first button guideline LB in the lateral direction D1. A distance between the second button guideline LF and the first button guideline LB in the lateral direction D1 is equal to or greater than the diameter of the button E placed to the presser device 9. A sub pattern image JA is projected between the first button guideline LB and the second button guideline LF.

As shown in FIG. 12, the button guideline LE extends in the lateral direction D1. The button guideline LE is projected at a distance from the sewing guideline LS in the longitudinal direction D2.

In the process of generating the projection image in S61, the type of the guideline in the projection image, the projecting conditions of the guidelines, the arrangement of the guidelines, may be properly set in response to instructions from the user.

Figure 10A:
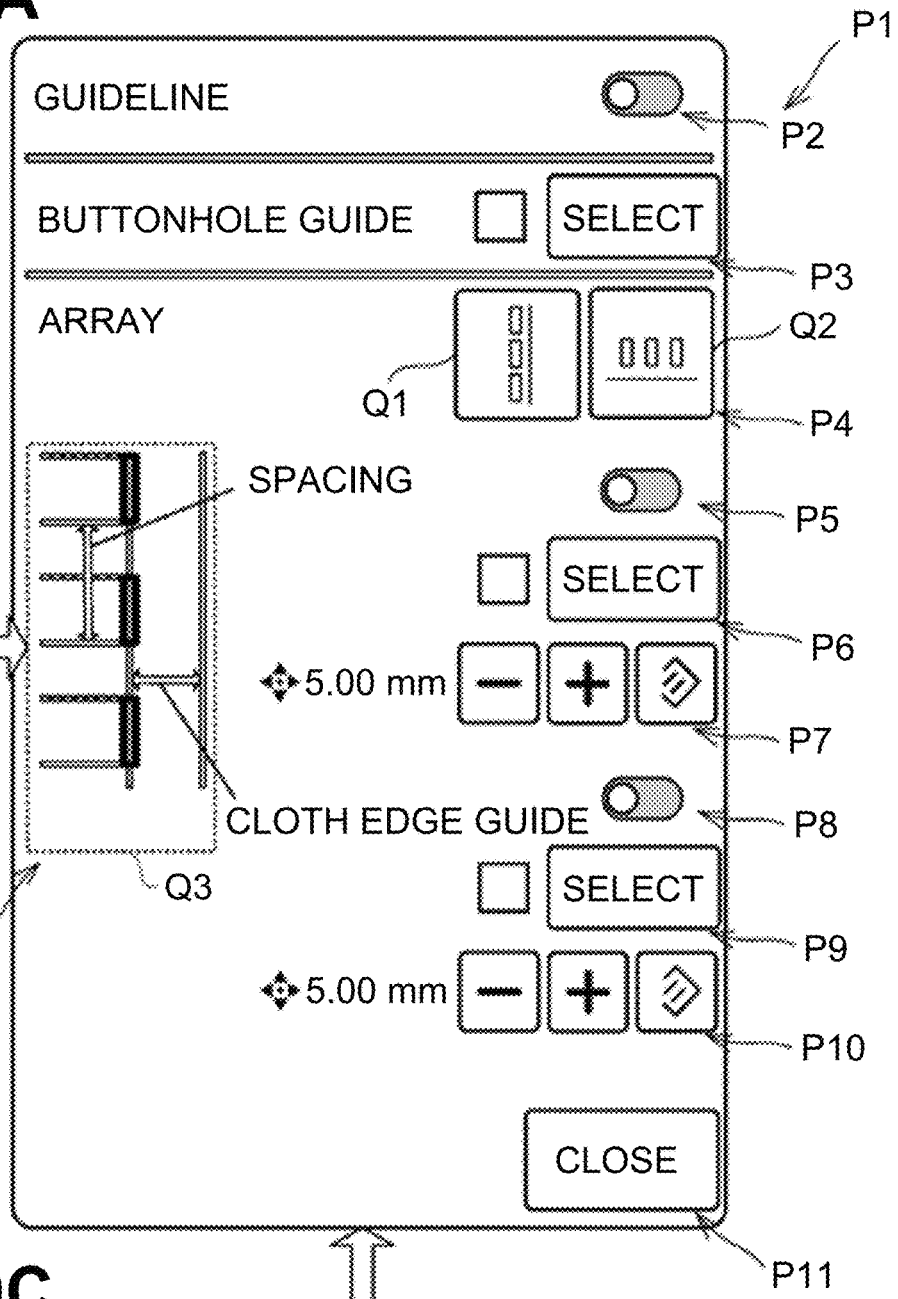
FIG. 10A is an explanatory diagram of a screen P1 displayed in the main processing when the first arrangement is selected.

The processor unit 3 drives the projector 2 based on the projection image generated in S61, and causes the projector 2 to project the projection image generated in S61 onto the projection area R1 (S62). As shown in FIG. 10A, the processor unit 3 causes the LCD 43 to display a screen P1 representing a guideline menu (S63).

As illustrated in FIG. 10A, the screen P1 includes switches P2, P5, P8, keys P3, P6, P7, P9, P10, P11, and fields P4, P12. The switch P2 is a toggle switch for switching between projecting and not projecting the sewing guideline LS. On the screen P1 of FIG. 10A, a knob of the switch P2 is positioned on the left side so that projecting the sewing guideline LS is set to OFF.

Figure 10B:
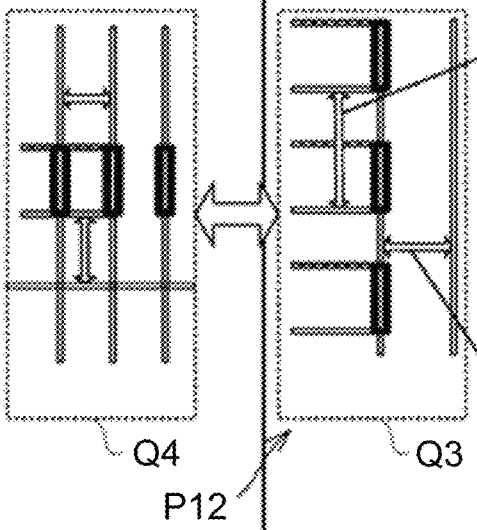
FIG. 10B is an explanatory diagram of an image Q4 displayed in a field P12 of a screen P1 when the second arrangement is selected.
Figure 10C:
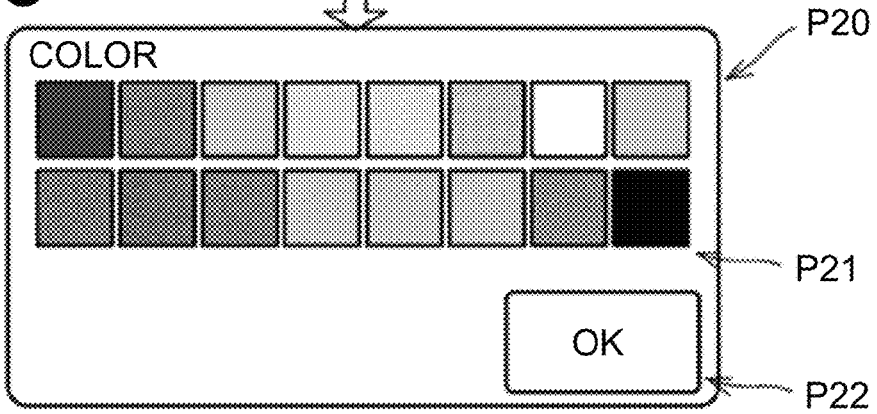
FIG. 10C is an explanatory diagram of a screen P20 displayed when the color of the guideline is set.

The key P3 is for setting the color of the sewing guideline LS. When the key P3 is pointed, the processor unit 3 causes the LCD 43 to display a screen P20 of FIG. 10C. As shown in FIG. 10C, the screen P20 includes a field P21 and a key P22. In the field P21, a plurality of color options of a target guideline is displayed. When the key P3 is pointed, the color of the sewing guideline LS, i.e., the target guideline, can be selected in the field P21. The key P22 is selected to set the color selected in the field P21.

In the field P4, keys Q1, Q2 are displayed as shown in FIG. 10A. The key Q1, Q2 are used to set the arrangement of the button guidelines and the workpiece guideline LC. The key Q1 is selected to set a first arrangement. The first arrangement may be set when the user requires a plurality of buttonhole patterns each extending in the longitudinal direction D2 are formed side by side in the lateral direction D1, and the end CE of the workpiece C extends in the lateral direction D1 on the right side with respect to the needle drop position NP.

The key Q2 is selected to set a second arrangement. The second arrangement may be set when the user requires a plurality of buttonhole patterns each extending in the lateral direction D1 are formed side by side in the longitudinal direction D2, and the end CE of the workpiece C extends in the longitudinal direction D2 in front of the needle drop position NP.

Thus, when the key Q1 is selected, the first button guideline LB and the second button guideline LF are projected as the button guidelines. When the key Q2 is selected, the button guideline LE is projected as the button guideline.

The switch P5 is a toggle switch for switching between displaying and not displaying the button guideline. In the screen P1 of FIG. 10A, the knob of the switch P5 is positioned on the left side so that displaying the button guideline is set to OFF. The key P6 is selected to set the color of the button guideline. When the key P6 is selected, the processor unit 3 causes the LCD 43 to display the screen P20, and sets the color of the button guideline in the same manner as in the case where the key P3 is selected. The key P22 is selected to set the color selected in the field P21. The key P7 is used to set a distance between adjacent buttonhole patterns.

The switch P8 is a toggle switch for switching between displaying and not displaying the workpiece guideline LC. In the screen P1 of FIG. 10A, the knob of the switch P8 is positioned on the left side so that displaying the workpiece guideline LC is set to OFF. The key P9 is selected to set the color of the workpiece guideline LC. When the key P9 is selected, the processor unit 3 causes the LCD 43 to display the screen P20, and sets the color of the workpiece guideline LC in the same manner as in the case where the key P3 is selected. The key P10 is selected to set a distance between the needle drop position NP and the end CE of the workpiece C.

The key P11 is selected to close the screen P1. The field P12 shows images of the needle bar guideline LN, the size guideline LD, the sewing guideline LS, the button guideline, and the workpiece guideline LC according to the setting of the screen P1 with the arrangement set in the field P4. In the screen P1 of FIG. 10A, an image Q3 where the first arrangement is selected by the key Q1 of the field P4 is displayed in the field P12. When the second arrangement is selected by the key Q1 in the field P4, an image Q4 shown in FIG. 10B is displayed in the field P12.

Based on inputs in the touchscreen 44, the processor unit 3 determines whether any operation for changing any setting has been detected (S64). If not detected (S64: NO), the processor unit 3 performs a process of S86 described below. If detected (S64: YES), the processor unit 3 determines whether an adjacent operation is detected (S65). The adjacent operation is an operation at any one of the field P4, the keys P6, P7, and the switch P5, for setting conditions for projecting the button guideline. The operation of setting the switch P5 from ON to OFF is detected at S81, instead of S65.

When the adjacent operation is detected (S65: YES), the processor unit 3 executes an arrangement determination process for determining an arrangement of the plurality of buttonhole patterns to the first arrangement or the second arrangement (S66). The arrangement may be determined in advance when the arrangement of a particular buttonhole patterns is determined in advance. If not determined in advance, the processor unit 3 of the present embodiment sets the arrangement of the plurality of buttonhole patterns to the first arrangement or the second arrangement based on the setting in the field P4. The processor unit 3 sets the color of the button guideline based on the setting of the key P6 (S67). The processor unit 3 sets the distance of the plurality of buttonhole patterns based on the setting of the key P7 (S68). The processor unit 3 generates a projection image including the button guidelines to be projected at a position distant from the needle drop position NP by a predetermined distance and causes the projector 2 to project the generated projection image (S69).

When the adjacent operation is not detected (S65: NO), the processor unit 3 determines whether a cloth edge operation is detected (S71). The cloth edge operation is an operation for designating a condition for projecting the workpiece guideline LC, and is an operation to any of the keys P9, P10 and the switch P8. The operation of setting the switch P8 from ON to OFF is detected at S81, instead of S65.

When the cloth edge operation is detected (S71: YES), the processor unit 3 sets the arrangement of the workpiece guideline LC with respect to the needle drop position NP based on the setting of the field P4 (S72). The processor unit 3 sets the color of the workpiece guideline LC based on the setting of the key P9 (S73). The processor unit 3 sets the distance of the workpiece guideline LC with respect to the needle drop position NP based on the setting of the key P10 (S74). The processor unit 3 generates a projection image including the workpiece guideline LC indicating the position of the end CE of the workpiece C based on the settings of S72, S73 and S74, and causes the projector 2 to project the generated projection image.

When the cloth edge operation is not detected (S71: NO), the processor unit 3 determines whether an OFF operation is detected (S81). The OFF operation is an operation for changing any one of the switches P2, P5, P8 from ON to OFF. When the OFF operation is detected (S81: YES), the processor unit 3 generates a projection image having the guideline corresponding to the OFF status excluded from the current projection image, and causes the projector 2 to project the generated projection image (S82).

When the OFF operation is not detected (S81: NO), the processor unit 3 determines whether the operation of the key P3 is detected (S83). When the operation of the key P3 is not detected (S83: NO), the processor unit 3 performs a process of S86 described below. When the operation of the key P3 is detected (S83: YES), the processor unit 3 sets the color selected in the field P21 of the screen P20 and input in the key P22 as the color of the sewing guideline LS (S84). The processor unit 3 generates a projection image that includes the sewing guideline LS that indicates the position of the stitches of the buttonhole pattern in the longitudinal direction D2, extends in the forward feed direction F, and has the set color. The processor unit 3 then causes the projector 2 to project the generated projection image (S85).

In S86, the processor unit 3 determines whether the key P11 is selected after any one of the steps S69, S75, S82, S85. When the key P11 is not selected (S86: NO), the processor unit 3 returns the process to S64. When the key P11 is selected (S86: YES), the processor unit 3 causes the projector 2 to end projecting (S87), and returns the process to the main process shown in FIG. 5.

In a case where the first arrangement is set and all of the needle bar guideline LN, the size guideline LD, the sewing guideline LS, the first button guideline LB, and the workpiece guideline LC are projected, the sewing machine 1 projects the projection image Q5 of FIG. 11 onto the projection area R1. The needle bar guideline LN and the size guideline LD extend in the longitudinal direction D2 in the extending direction J with respect to the presser device 9. The position of the needle bar guideline LN in the lateral direction D1 is the same as the needle drop position NP. The size guideline LD is located in the forward feed direction F at a distance corresponding to the size of the button E from the needle drop position NP. The pattern image J1 is located between the needle bar guideline LN and the size guideline LD in the lateral direction D1.

The distance W1 between the distal ends of adjacent buttonhole patterns in the lateral direction D1 corresponds to a value set by the key P7. The distance W2 between the sewing guideline LS and the workpiece guideline LC in the longitudinal direction D2 corresponds to a value set by the key P10. The user may adjust the position of the end CE of the workpiece C in the longitudinal direction D2 with reference to the workpiece guideline LC. Each of the sewing guideline LS and the workpiece guideline LC extends from the side R4 that is the front end of the projection area R1 to the side R3 that is the rear end of the projection area R1.

The projection image Q5 includes a combination of the sub pattern image JA, the second button guideline LF and the first button guideline LB, in addition to a combination of the pattern image J1, the size guideline LD and the needle bar guideline LN. The projected location of the pattern image J1 is set such that the pattern image J1 does not overlap the presser device 9. As the user sews a plurality of buttonhole patterns V on the workpiece C in order from the rear side, the user can check whether the buttonhole pattern V to be sewn is appropriately arranged with respect to the sewn buttonhole pattern V by checking whether the first button guideline LB arranged on the rear side of the needle bar guideline LN passes through the rear end of the sewn buttonhole pattern V.

In a case where the second arrangement is set and all of the needle bar guideline LN, the size guideline LD, the sewing guideline LS, the button guideline LE, and the workpiece guideline LC are projected, the sewing machine 1 projects the projection image Q6 of FIG. 12 onto the projection area R1. The needle bar guideline LN and the size guideline LD extend in the longitudinal direction D2 in the extending direction J with respect to the presser device 9. The position of the needle bar guideline LN in the lateral direction D1 is the same as the needle drop position NP. The size guideline LD is located in the forward feed direction F at a distance corresponding to the size of the button E from the needle drop position NP. The pattern image J1 is located between the needle bar guideline LN and the size guideline LD in the lateral direction D1.

The distance W3 between adjacent buttonhole patterns in the longitudinal direction D2 corresponds to a value set by the key P7. The distance W4 between the sewing guideline LS and the workpiece guideline LC in the lateral direction D1 corresponds to a value set by the key P10. In FIG. 12, the workpiece guideline LC is projected over the workpiece C. Therefore, the user may adjust the position of the end CE of the workpiece C in the lateral direction D1 with reference to the workpiece guideline LC. The sewing guideline LS and the button guideline LE each extend between the side R4 and the side R3 of the projection area R1. The workpiece guideline LC extends between the side R6 and the side R7 of the projection area R1. The user can check whether the buttonhole pattern V is properly sewn with respect to the sewn buttonhole pattern V by checking the button guideline LE on the right of the sewing guideline LS passes through the center of the sewn buttonhole pattern V.

After S3 or S5, the processor unit 3 performs a process of S6 described later. When the guideline-projecting instruction has not been detected (S4: NO), the processor unit 3 determines whether a sewing-start instruction via the start/stop switch 45 has been detected (S6). When the sewing-start instruction has not been detected (S6: NO), the processor unit 3 returns the process to S2. When the sewing-start instruction is detected (S6: YES), the processor unit 3 controls movement of the feed dog 32 and the needle bar 15 to form stitches of the buttonhole pattern corresponding to the pattern image J1 projected on the workpiece C at S3 or S5 (S7). The process of S7 may be executed while projecting the pattern image J1, or may be executed without projecting the pattern image J1. Then, the processor unit 3 ends the main processing.

In the above-described embodiment, the sewing machine 1 is an example of a sewing machine of the present invention. The projector 2 is an example of a projector according to the present invention. The processor unit 3 is an example of a processor of the present invention. The image sensor 8 is an example of a processor of the present invention. The presser device 9 is an example of a buttonhole device of the present invention. The bed 11 is an example of a bed of the present invention. The pillar 12 is an example of a pillar of the present invention. The needle bar 15 is an example of a needle bar of the present invention. The presser bar 16 is an example of a presser bar of the present invention. The sewing needle 17 is an example of a sewing needle of the present invention. The feed dog 32 is an example of a feed dog of the present invention. The lateral direction D1 is an example of a lateral direction of the present invention. The longitudinal direction D2 is an example of a longitudinal direction of the present invention. The forward feed direction F is an example of a forward feed direction of the present invention. The pattern image J1 is an example of a pattern image of the present invention. The sub pattern image JA is an example of a sub pattern image of the present invention. The first button guideline LB is an example of a first button guideline of the present invention. The button guideline LE is an example of a button guideline of the present invention. The second button guideline LF is an example of a second button guideline of the present invention. The workpiece guideline LC is an example of a workpiece guideline of the present invention. The size guideline LD is an example of a size guideline of the present invention. The needle bar guideline LN is an example of a needle bar guideline of the present invention. The sewing guideline LS is an example of a sewing guideline of the present invention. The projection area R1 is an example of a projection area of the present invention. The imaging area R2 is an example of an imaging area of the present invention.

The sewing machine 1 of the above-described embodiment includes the pillar 12, the bed 11, the needle bar 15, the presser bar 16, the projector 2, the feed dog 32, and the processor unit 3. The pillar 12 extends in the up-down direction. The bed 11 extends from a lower end of the pillar 12 in an extending direction J orthogonal to the up-down direction. The projector 2 is configured to project a projection image onto a projection area R1 on the bed 11. The feed dog 32 is provided on the bed 11 and is configured to move the workpiece C on the bed 11. The processor unit 3 performs a projecting process (S12, S62) in which a projection image including a pattern image J1 representing a buttonhole pattern formed in a state in which the presser device 9 is mounted to the presser bar 16 is projected onto the projection area R1, and a sewing process (S7) in which the buttonhole pattern represented by the pattern image J1 is formed on the workpiece C by controlling movement of the feed dog 32 and the needle bar 15 in a state in which the presser device 9 is mounted to the presser bar 16. The processor unit 3 of the sewing machine 1 may contribute to higher usability of confirming the stitches of the buttonhole pattern by checking the projection image projected on the projection area R1 before actually sewing the stitches of the buttonhole pattern.

In the sewing machine 1 of the above-described embodiment, a direction from the needle bar 15 toward the presser bar 16 is defined as a forward feed direction F. The buttonhole pattern is formed in the forward feed direction F beyond the needle drop position NP below the needle bar 15 in a state where the presser device 9 is mounted to the presser bar 16. The pattern image J1 is projected in the forward feed direction F beyond the needle drop position NP. The projection process may contribute to higher usability of notifying the user of a location where the stitches of the selected buttonhole pattern are formed.

In a state where the presser device 9 is mounted to the presser bar 16, the pattern image J1 is projected at a position that does not overlap the presser device 9. In general, when a pattern image is projected at a position where a stitch of a buttonhole pattern is formed in a state where the presser device 9 is mounted on the presser bar 16, the buttonhole pattern is projected behind the needle bar 15. In this comparative case, since the pattern image overlaps with the presser device 9 and the needle bar 15 blocks the user's view, it is difficult for the user to visually recognize the projected pattern image. In contrast, the projecting process executed by the processor unit 3 of the sewing machine 1 according to the above-described embodiment may contribute to higher usability of easier visual recognition of the projected pattern image J1.

The pattern image J1 included in the projection image is projected between the end 18 of the bed 11 in the extending direction J and the needle drop position NP below the needle bar 15. The projecting process executed by the processor unit 3 of the sewing machine 1 may contribute to higher usability of easier visual recognition of the projected pattern image J1.

The projection image includes a needle bar guideline LN extending in the longitudinal direction D2. The needle drop position NP below the needle bar 15 is positioned on the needle bar guideline LN or on an extension of the needle bar guideline LN. The projection process executed by the processor unit 3 of the sewing machine 1 may contribute to higher usability of visualizing a sewing start position of the buttonhole pattern with the needle bar guideline LN.

The projection image includes a size guideline LD extending in the longitudinal direction D2. An end JE of the pattern image J1 in the forward feed direction F is located on the size guideline LD or on an extension of the size guideline LD. The size guideline LD projected in the projection process executed by the processor unit 3 of the sewing machine 1 indicates a rear end position of the buttonhole pattern to the user. In the projecting process executed by the processor unit 3 of the sewing machine 1, a range in which the stitches of the buttonhole pattern are formed, that is, the length of the lateral direction D1 of the buttonhole pattern, is indicated to the user by projecting both the needle bar guideline LN and the size guideline LD at the same time. Thus, the projection process executed by the processor unit 3 of the sewing machine 1 contributes to higher usability.

The size guideline LD is distant from the needle bar guideline LN in the forward feed direction F. The distance in the forward feed direction F between the size guideline LD and the needle bar guideline LN is equal to or greater than the size, i.e., the diameter, of the button E placed on the presser device 9. The projecting processing executed by the processor unit 3 of the sewing machine 1 contributes to higher usability as the user may recognize the length of the buttonhole pattern based on the size of the button E that may actually be attached to the workpiece C.

The pattern image J1 is projected between the needle bar guideline LN and the size guideline LD. In the projecting process executed by the processor unit 3 of the sewing machine 1, the range in which the stitches of the buttonhole pattern are formed, that is, the length of the lateral direction D1 of the buttonhole pattern, is indicated to the user by projecting the pattern image J1, the needle bar guideline LN, and the size guideline LD at the same time. Thus, the projection process executed by the processor unit 3 of the sewing machine 1 contributes to higher usability.

The projection image includes a sewing guideline LS extending in the forward feed direction F. The needle drop position NP below the needle bar 15 is located on the sewing guideline LS or on an extension of the sewing guideline LS. The sewing guideline LS projected in the projection process executed by the processor unit 3 of the sewing machine 1 indicates a position of the buttonhole pattern in the longitudinal direction D2 to the user.

The projected pattern image J1 extends in parallel to the sewing guideline LS. The projection process executed by the sewing machine 1 contributes to higher usability of notifying the user of a location where the stitches of the buttonhole pattern are formed.

In a state where the presser device 9 is mounted to the presser bar 16, the sewing guideline LS is projected onto the presser device 9. The sewing guideline LS projected in the projecting process executed by the processor unit 3 of the sewing machine 1 indicates to the user that the buttonhole pattern is formed at the position indicated by the sewing guideline LS, not at the position where the pattern image J1 is projected. Thus, the projecting process executed by the processor unit 3 of the sewing machine 1 contributed to higher usability.

A direction along the forward feed direction F and orthogonal to the longitudinal direction D2 is defined as a lateral direction D1. The projection image Q5 includes a first button guideline LB extending in the longitudinal direction D2. The first button guideline LB is projected so as to be parallel to and distant from the needle bar guideline LN. The projecting process executed by the processor unit 3 of the sewing machine 1 contributes to higher usability of recognizing a plurality of the buttonhole pattern to be formed side by side at the first button guideline LB.

The projection image Q5 includes a second button guideline LF extending in the longitudinal direction D2. The second button guideline LF is projected so as to be parallel to and distant from the first button guideline LB. The distance between the second button guideline LF and the first button guideline LB in the lateral direction D1 is equal to or greater than the size, i.e., the diameter, of the button E placed to the presser device 9. In the projection processing executed by the processor unit 3 of the sewing machine 1, projecting the needle bar guideline LN, the second button guideline LF, and the first button guideline LB at the same time indicates to the user a position where the buttonhole pattern next to the buttonhole pattern formed at the needle drop position NP is formed. Thus, the projecting process executed by the processor unit 3 of the sewing machine 1 contributes to higher usability.

The projection image Q5 includes a sub pattern image JA representing the buttonhole pattern. The sub pattern image JA is projected between the first button guideline LB and the second button guideline LF so as to be distant from the pattern image J1 in the lateral direction D1. In the projection processing executed by the processor unit 3 of the sewing machine 1, projecting the sub pattern image JA, the first button guideline LB, the second button guideline LF at the same time indicates to the user a range where the buttonhole pattern next to the buttonhole pattern formed at the needle drop position NP is formed. Thus, the projecting process executed by the processor unit 3 of the sewing machine 1 contributes to higher usability.

A direction along the forward feed direction F and orthogonal to the longitudinal direction D2 is defined as a lateral direction D1. The projection image Q6 includes a button guideline LE extending in the lateral direction D1. The button guideline LE is projected at a distance from the sewing guideline LS in the longitudinal direction D2. The projecting process executed by the processor unit 3 of the sewing machine 1 contributes to higher usability to visually recognize where the plurality of the buttonhole patterns are formed along the button guideline LE.

The projection image includes the workpiece guideline LC representing the end CE of the workpiece C. The projection processing executed by the processor unit 3 of the sewing machine 1 contributes to higher usability to arrange the end CE of the workpiece C on the bed 11 by referring to the workpiece guideline LC.

The sewing machine 1 includes an image sensor 8 configured to capture an image of an imaging area R2 that includes a part of the projection area R1, and to generate a captured image. The processor unit 3 executes a size detection process for detecting the size of the button E placed to the presser device 9 based on the captured image (S19). The projection image includes the pattern image J1 based on the size of the button E. The size detection process executed by the processor unit 3 of the sewing machine 1 may contribute to higher usability of automatically obtaining the size, i.e., the diameter, of the button and projecting the pattern image J1 based on the obtained size of the button.

The projection image includes an operation key for controlling a parameter of the buttonhole pattern. The processor unit 3 executes an indication detection process for detecting an indication position indicating a position indicated by the pointing device (S14). The processor unit 3 executes a parameter detection process for obtaining operation data of the parameter corresponding to the operation key projected on the indication position (S43). The projection image includes the pattern image J1 based on the operation data of the parameter. The instruction detection processing executed by the processor unit 3 of the sewing machine 1 may contribute to higher usability of obtaining parameters of the buttonhole pattern by simply using the pointing device to the projection image.

The sewing machine 1 includes an image sensor 8 configured to capture an image of an imaging area R2 that includes a part of the projection area R1, and to generate a captured image. The processor unit 3 detects the indication position based on the captured image in the indication detection process. The image sensor 8 of the sewing machine 1 may contribute to higher usability of automatically obtaining the size, i.e., the diameter, of the button E based on the captured image.

The projection image includes the start key J5 for instructing to start the size detection process. The processor unit 3 executes an indication detection process for detecting an indication position indicated by the pointing device (S14). When the start key J5 is projected at the indication position, the processor unit 3 executes the size detection process. The size detection processing that is executed by the processor unit 3 of the sewing machine 1 may contribute to higher usability of automatically detecting the size, i.e., the diameter, of the button E.

The buttonhole pattern includes a first stitch stack N1 and a second stitch stack N2, each extending in the lateral direction D1. The first stitch stack N1 and the second stitch stack N2 are located to face each other in the longitudinal direction D2. The buttonhole pattern further includes a third stitch stack N3 and a fourth stitch stack N4, each extending in the longitudinal direction D2. The third stitch stack N3 and the fourth stitch stack N4 are located to face each other in the lateral direction D1. The projection images Q5, Q6 include the pattern image J1 representing the buttonhole pattern in which the length B2 of the first stitch stack N1 and the second stitch stack N2 in the lateral direction D1 are determined based on the length of the button E in the lateral direction D1. The sewing machine 1 may contribute to higher usability of projecting the pattern image J1 with the stitch stacks N1, N2 as actually sewn on the workpiece C.

The processor unit 3 determines whether the presser device 9 is mounted to the presser bar 16, and executes the size detection processing (S19) only when it is determined that the presser device 9 is mounted to the presser bar 16.

The sewing machine 1 includes the presser device 9 attachable to the presser bar 16.

The present invention may not be limited to the above-described embodiment. Various modifications may be available.

The sewing machine 1 may include a carrier mechanism that can hold and carry an embroidery frame in the front-rear direction and the left-right direction. The embroidery frame may be configured to hold the workpiece C such that the sewing machine 1 may sew the embroidery pattern while moving the workpiece C held by the embroidery frame by the carrier mechanism.

The sewing machine 1 need not be provided with the presser device 9.

The sewing machine 1 may include a moving mechanism to be caused to drive the feed dog 32 to move the workpiece C in the left-right direction, instead of using the swing mechanism 36.

The type of the projector 2, location of the projector 2, how and where the projector 2 is installed, and the projection area R1 of the projector 2 may vary within the scope of the present invention.

The projection area R1 may not include the needle drop position NP. The projection area R1 may have a shape, such as a square shape, other than the rectangular shape. The projection area R1 may have a rectangular shape in which its long side extends in the extending direction J. The side R4 forming the end of the projection area R1 in the forward feed direction F may be positioned further in the backward feed direction B than the end 39 of the needle plate 41 in the forward feed direction F.

The light source 212 of the projector 2 may be located in the backward feed direction B with respect to the first lens 23. The sewing machine 1 may not be provided with the image sensor 8.

The type of the image sensor 8, location of the image sensor 8, and the imaging area R2 of the image sensor 8 may vary within the scope of the present invention. The location of the image sensor 8 with respect to the projector 2 may also vary as appropriate.

The projection image may be generated by another device, such as a personal computer or a smartphone, and then the generated projection image may be transmitted to the sewing machine 1.

The pattern image may be an image representing the smallest rectangle that encloses the buttonhole pattern, or an image representing the outline of the buttonhole pattern.

The buttonhole pattern may be arranged in the backward feed direction B from the needle drop position NP. In this case, the projection process may include projecting a projection image such that the end of the pattern image is projected at a position further in the backward feed direction B than the needle drop position NP.

The projection image may be projected such that a part of the pattern image may be projected at an area extending from the needle drop position NP along the forward feed direction F and the backward feed direction B while the buttonhole pattern is being sewn.

The projection image may be generated such that at least a part of the pattern image is projected at a position overlapping the presser device 9.

The projection image may be generated such that the pattern image is not projected between the end 18 of the bed 11 in the extending direction J and the needle drop position NP. The projection image may be generated such that one or more of the needle bar guideline LN, the first button guideline LB, the button guideline LE, the second button guideline LF, the workpiece guideline LC, and the size guideline LD may not be projected.

The projection image may be generated without an instruction to include one or more of the needle bar guideline LN, the first button guideline LB, the button guideline LE, the second button guideline LF, the workpiece guideline LC, and the size guideline LD in the projection image.

The sewing machine 1 may not set the color of one or more of the needle bar guideline LN, the first button guideline LB, the button guideline LE, the second button guideline LF, the workpiece guideline LC, and the size guideline LD. The sewing machine 1 may set a line style, such as a straight line, a dotted line, and an alternate long and short dash line, for one or more of the needle bar guideline LN, the first button guideline LB, the button guideline LE, the second button guideline LF, the workpiece guideline LC, and the size guideline LD. The sewing machine 1 may set a thickness, a length, or both for one or more of the needle bar guideline LN, the first button guideline LB, the button guideline LE, the second button guideline LF, the workpiece guideline LC, and the size guideline LD.

The sewing machine 1 may be configured to accept the size of the button manually input by the user, instead of executing the size detection process. The size of the button may be the area of the button, the radius of the button, and the area of the smallest rectangle that encloses the button. The size detection process may be executed based on a signal input in the touchscreen 44.

The pattern image may not include the first to fourth stitch stacks. The length of the pattern image J1 in the lateral direction D1 in the projection image may be determined based on the length of the first stitch stack N1 and the second stitch stack N2 in the lateral direction D1 and the length of the third stitch stack N3 and the fourth stitch stack N4 in the lateral direction D1, which are set in accordance with the length of the button E in the lateral direction D1.

The size detection processing may be executed while it is not determined in S18 that the presser device 9 is mounted to the presser bar 16.

What is claimed is:

1. A sewing machine comprising:

a pillar extending in an up-down direction;

a bed extending from a lower end of the pillar in an extending direction orthogonal to the up-down direction;

a needle bar;

a presser bar;

a projector configured to project a projection image onto a projection area on the bed;

a feed dog provided on the bed and configured to move a workpiece on the bed; and a processor configured to execute:

projecting a projection image onto the projection area, the projection image including a pattern image representing a buttonhole pattern, the buttonhole pattern being formed in a state in which a buttonhole presser is mounted to the presser bar; and sewing the buttonhole pattern on the workpiece by controlling the feed dog and the needle bar, wherein the projecting includes projecting the pattern image that does not overlap the buttonhole presser in a state in which the buttonhole presser is mounted to the presser bar.

2. The sewing machine according to claim 1, wherein a forward feed direction is from the needle bar toward the presser bar, the buttonhole pattern is a pattern formed in the forward feed direction from a needle drop position in a state in which the buttonhole presser is mounted to the presser bar, the needle drop position being located below the needle bar and the projecting includes projecting the pattern image in the forward feed direction beyond the needle drop position.

3. The sewing machine according to claim 1, wherein the projecting includes projecting the pattern image between an end of the bed in the extending direction and a needle drop position, the needle drop position being located below the needle bar.

4. The sewing machine according to claim 1, wherein a forward feed direction is from the needle bar toward the presser bar, a longitudinal direction is orthogonal to the forward feed direction and the up-down direction, and the projection image includes a needle bar guideline extending in the longitudinal direction, a needle drop position being located on or along with the needle bar guideline, the needle drop position being located below the needle bar.

5. The sewing machine according to claim 4, wherein the projection image includes a size guideline extending in the longitudinal direction, a position of an end of the pattern image in the forward feed direction being located on or along with the size guideline.

6. The sewing machine according to claim 5, wherein the size guideline is distant from the needle bar guideline in the forward feed direction, and a distance between the size guideline and the needle bar guideline in the forward feed direction is equal to or greater than a button size, the button size being a size of a button placed to the buttonhole presser.

7. The sewing machine according to claim 5, wherein the projecting includes projecting the pattern image between the needle bar guideline and the size guideline.

8. The sewing machine according to claim 4, wherein a lateral direction is along the forward feed direction and is orthogonal to the longitudinal direction, the projection image includes a first button guideline extending in the longitudinal direction, and the projecting includes projecting the first button guideline spaced from the needle bar guideline in the lateral direction.

9. The sewing machine according to claim 8, wherein the projection image includes a second button guideline, the projecting includes projecting the second button guideline spaced from the first button guideline in the lateral direction, and a distance between the second button guideline and the first button guideline in the lateral direction is equal to or greater than a button size, the button size being a size of a button placed to the buttonhole presser.

10. The sewing machine according to claim 9, wherein the projection image includes a sub pattern image representing the buttonhole pattern, and the projecting includes projecting the sub pattern image between the first button guideline and the second button guideline, and spaced from the pattern image in the lateral direction.

11. The sewing machine according to claim 1, wherein a forward feed direction is from the needle bar toward the presser bar, a longitudinal direction is orthogonal to the forward feed direction and the up-down direction, and the projection image includes a sewing guideline extending in the forward feed direction, a needle drop position being located on or along with the sewing guideline, the needle drop position being located below the needle bar.

12. The sewing machine according to claim 11, wherein the projecting includes projecting the pattern image in parallel with the sewing guideline.

13. The sewing machine according to claim 11, wherein the projecting includes projecting the sewing guideline on the buttonhole presser in a state in which the buttonhole presser is mounted to the presser bar.

14. The sewing machine according to claim 11, wherein a lateral direction is along the forward feed direction and is orthogonal to the longitudinal direction, the projection image includes a button guideline extending in the lateral direction, and the projecting includes projecting the button guideline spaced from the sewing guideline in the longitudinal direction.

15. The sewing machine according to claim 1, wherein the projection image includes a workpiece guideline representing an end of the workpiece.

16. The sewing machine according to claim 1, wherein the sewing machine further comprises an image sensor for capturing an imaging area, the imaging area including a part of the projection area on the bed, the processor is further configured to execute detecting a size of a button placed to the buttonhole presser based on output of the image sensor, and the projection image includes the pattern image based on the size of the button.

17. The sewing machine according to claim 16, wherein the projection image includes a start key for instructing to start detecting of the size of the button, and the processor is further configured to execute:

detecting an indicated position representing a position indicated by an indicator; and detecting the size of the button placed to the buttonhole presser in a case where the start key is projected on the indicated position.

18. The sewing machine according to claim 1, wherein the projection image includes one or more operation keys for controlling a parameter of the buttonhole pattern, the processor is further configured to execute:

detecting an indicated position representing a position indicated by an indicator; and obtaining operation data of the parameter corresponding to an operation key projected on the indicated position among the one or more operation keys, and the projection image includes the pattern image based on the operation data of the parameter.

19. The sewing machine according to claim 18, wherein the sewing machine further comprises an image sensor for capturing an imaging area, the imaging area including a part of the projection area on the bed, the processor is further configured to execute detecting the indicated position based on output of the image sensor.

20. The sewing machine according to claim 1, wherein:

a forward feed direction is from the needle bar toward the presser bar, a longitudinal direction is orthogonal to the forward feed direction and the up-down direction, a lateral direction is along the forward feed direction and is orthogonal to the longitudinal direction, the pattern image includes:

a first stitch stack and a second stitch stack each extending in the lateral direction and facing in the longitudinal direction; and a third stitch stack and a fourth stitch stack each extending in the longitudinal direction and facing in the lateral direction, and the greater a size of a button in the lateral direction is, the greater each length of the first stitch stack and the second stitch stack in the lateral direction is.

21. The sewing machine according to claim 1, wherein:

the sewing machine further comprises an image sensor for capturing an imaging area, the imaging area including a part of the projection area on the bed, and the processor is further configured to execute:

detecting a size of a button placed to the buttonhole presser based on output of the image sensor, and determining whether the buttonhole presser is mounted to the presser bar, and the detecting includes detecting the size of the button in a case where it is determined that the buttonhole presser is mounted to the presser bar.

22. The sewing machine according to claim 21, wherein a forward feed direction is from the needle bar toward the presser bar, the buttonhole pattern is a pattern formed in the forward feed direction from a needle drop position in a state in which the buttonhole presser is mounted to the presser bar, the needle drop position being located below the needle bar and the projecting includes projecting the pattern image in the forward feed direction beyond the needle drop position.

23. The sewing machine according to claim 1, wherein the sewing machine further comprises the buttonhole presser attachable to the presser bar.

* * * * *